US011084611B2

(12) United States Patent
Thürig

(10) Patent No.: US 11,084,611 B2
(45) Date of Patent: Aug. 10, 2021

(54) PROCESS AND APPARATUS FOR EVACUATION OF PACKAGES

(71) Applicant: Cryovac, LLC, Charlotte, NC (US)

(72) Inventor: Peter Thürig, Eich (CH)

(73) Assignee: Cryovac, LLC, Charlotte, NC (US)

( * ) Notice: Subject to any disclaimer, the term of this patent is extended or adjusted under 35 U.S.C. 154(b) by 87 days.

(21) Appl. No.: 16/341,109

(22) PCT Filed: Nov. 17, 2017

(86) PCT No.: PCT/EP2017/079595
§ 371 (c)(1),
(2) Date: Apr. 11, 2019

(87) PCT Pub. No.: WO2018/091655
PCT Pub. Date: May 24, 2018

(65) Prior Publication Data

US 2020/0039670 A1 Feb. 6, 2020

(30) Foreign Application Priority Data

Nov. 18, 2016 (EP) ..... 16199676

(51) Int. Cl.

| | |
|---|---|
| ***B65B 31/00*** | (2006.01) |
| ***B65B 31/02*** | (2006.01) |
| ***B65B 51/14*** | (2006.01) |
| ***B65B 57/02*** | (2006.01) |

(52) U.S. Cl.
CPC ..... *B65B 31/024* (2013.01); *B65B 51/146* (2013.01); *B65B 57/02* (2013.01)

(58) Field of Classification Search
CPC ..... B65B 31/00; B65B 31/02; B65B 31/024; B65B 31/04; B65B 57/00; B65B 57/005; B65B 57/02
See application file for complete search history.

(56) References Cited

U.S. PATENT DOCUMENTS

| | | | | |
|---|---|---|---|---|
| 3,832,824 | A | 9/1974 | Burrell | |
| 3,965,646 | A | 6/1976 | Hawkins | |
| 2012/0174531 | A1* | 7/2012 | Rothermel | B65B 31/024 53/432 |
| 2015/0040517 | A1* | 2/2015 | Furuse | B65B 51/146 53/405 |
| 2018/0319523 | A1* | 11/2018 | Palumbo | B65B 61/005 |

FOREIGN PATENT DOCUMENTS

| | | | | |
|---|---|---|---|---|
| EP | 1564147 | A1 | 8/2005 | |
| EP | 2832649 | A1 | 2/2015 | |
| WO | WO-2017081107 | A1 * | 5/2017 | B65B 61/005 |

* cited by examiner

*Primary Examiner* — Chelsea E Stinson
(74) *Attorney, Agent, or Firm* — Jon M. Isaacson

(57) ABSTRACT

An evacuation station has a first chamber, a second chamber, and a dividing wall separating the first and second chambers. The dividing wall has a gap fluidly coupling the first and second chambers. The second chamber is fluidly coupled to a vacuum source. A package is made from a film and is arranged in the evacuation station. An inner volume of the package is in fluid communication with an inner volume of the second chamber via the open end. A control unit controls a pressure differential between a first internal pressure in the first chamber and a second internal pressure in the second chamber to cause aspiration of gas from the inner volume of the package.

21 Claims, 8 Drawing Sheets

PROCESS AND APPARATUS FOR EVACUATION OF PACKAGES

TECHNICAL FIELD

The present invention relates to a packaging process using a double-chamber evacuation station and a packaging apparatus comprising a double-chamber evacuation station.

BACKGROUND ART

A packaging apparatus can be used to package a food product. The product can be a bare product or a product pre-loaded onto a tray. A tube of plastic wrap can be continuously fed through a bag/package forming, filling and sealing apparatus. The film and the product are joined, for example the product is deposited on the film or the film is wrapped around the product. In some examples, the bare product is fed through an infeed belt. A tube is created around the product by joining together and sealing opposite longitudinal edges of the film. Alternatively, the product is placed in the tube and a leading edge (at the downstream end) of the packaging material is sealed. Then the tube is sealed at the trailing edge (at the upstream end) of the package and is severed from the continuously moving tube of packaging material.

In some embodiments, the tube can be provided as a tube, or be formed from two films or webs sealed longitudinally at two longitudinal edges, or from a single film that is folded over and sealed along its longitudinal edges. In other embodiments, products are loaded into pre-formed bags, which are then supplied to an evacuation station and to a sealing station or to a combined evacuation/sealing station. Further, some embodiments can facilitate evacuation of multiple packages at the same time in the same process step. The latter can be realized, for example, by processing multiple bags using a single vacuum system.

Sealing bars or sealing rolls can be used to create seals in the packaging material. If sealing bars are employed, a lower bar and an upper bar may be moved with respect to one another in order to contact each other while squeezing the packaging material between the bars and providing one or more seals, for example based on heat-sealing. Actuating sealing bars in this manner typically requires the sealing bars being stationary relative to the package. Sealing rolls can be employed in order to maintain a continuous motion of packages on a conveyor belt. In some examples, packages are placed on a conveyor belt in an orientation where an unsealed end of the package, for example the open edge of a bag holding a product, is located laterally on the side of the conveyor with respect to a main movement direction of the conveyor. The open ends of the packages can then be fed through sealing rolls, which perform, for example, heat sealing of the package material. The seals are typically transversally extending regions, stripes, or bands of packaging material that have been processed (e.g. heat-treated) to provide a seal between the inside of the packaging and the environment.

In the context of this document, whenever evacuation or vacuumization in terms of gas extraction is referred to, it is understood that the term "gas" can comprise an individual particular gas or a mixture of gases and may, for example, refer to air (i.e. consist of a mixture of gases corresponding to ambient air). In some embodiments, packages can be flushed with protective gas or gases (sometimes also referred to as "inert" gas) prior to evacuation and/or sealing. It is noted that any known inert or protective gas or gas mixture can be employed, for example $CO_2$ or gas mixtures having very low $O_2$ content (e.g. below 1%).

Gas can be injected into the package in the space between the product and the film using known techniques. Remaining gas inside the package after gas or air has been evacuated therefrom and after the package has been sealed ensures a desired residual level of $O_2$ inside the package (e.g., a residual level of $O_2$ of 1% or lower). Reducing the level of residual $O_2$ in the package is particularly beneficial when packaging perishable products (e.g. cheese with low gassing level during maturation).

A packaging apparatus is typically used for numerous different products with respect to, for example, the type of product, size, weight, and composition. Some packaging machines employ one or more vacuum chambers, typically one of which is designed to house one or more entire products to be evacuated. During evacuation, several issues with respect to efficiency, effectiveness, and maintaining product properties may arise. For example, the evacuation process must be carefully controlled based on the product being packaged when aiming to efficiently and effectively evacuate a package. Generally, it is desired to evacuate a package as quickly as possible and as much as possible in order to process a maximum number of packages within a give time and/or to evacuate the packages to a specific degree, for example minimizing residual gas/air content in the packages.

In some applications, for example when packaging irregularly shaped products (e.g. vegetables) and/or products having internal cavities (e.g. cheese) it may be difficult to evacuate gas/air from around the entire product and/or from within the product. In some cases, the evacuation process may cause portions of packaging material to prematurely adhere to the product in some areas, thereby preventing or at least making it more difficult to evacuate gas/air from other or adjacent areas within the package. This may occur, in particular, when the evacuation is performed very quickly and/or unevenly from different areas within the package, for example due to the shape of the product to be packaged.

In other cases, the evacuation process may cause the product to evaporate fluid, for example water, which transitions from liquid into gaseous form and is evacuated along with the gas/air contained within the package, an effect typically referred to as steaming. Steaming may occur, in particular, when the evacuation process is performed with very low target pressures, for example less than 20 mbar. When packaging food items having a relatively high liquid content (e.g. meat), any loss of product weight due to fluid loss may be critical due to its economic impact. For example, processing a large number of products, each product losing some small percentage of weight during evacuation, can result in considerable financial losses in a relatively short period of time. Steaming may occur primarily at target pressures of 20 mbar or less. However, depending on additional process parameters, for example ambient temperature and pressure, rate of evacuation, product properties, and other, steaming can occur at higher or lower pressures. It may be beneficial to adjust the rate of evacuation at lower pressures in order to avoid or minimize steaming.

US 2012/0174531, U.S. Pat. No. 9,073,654, and EP2468638 disclose a packaging machine and a method of forming a vacuum package. Evacuable chambers respectively house a product-accommodating section of a package and an opening section of the package. Pressure gauges measure the pressure in both chambers, and a supply air valve serves to supply air from a supply line into the product-accommodating chamber. The supply air valve is a control valve and is controlled depending on the difference between the pressures the chambers or depending on the difference between the pressure in a chamber and a target pressure for that chamber. Further, a gap is provided in a partition between the two chambers and an adjuster is provided for varying and adjusting the cross-sectional area of the gap. The chambers can be fluidly connected by a bypass line and bypass valve, the latter also being used to control the pressure difference between the two chambers. U.S. Pat. No. 9,073,654 particularly specifies that an opening of the supply air valve leading into the first chamber is arranged in a wall of the first chamber located opposite the partition. Further, a common horizontal plane passes through both the opening of the supply air valve leading into the first chamber and the gap.

An aim of the present invention is to provide a packaging apparatus and process that facilitate effective and efficient packaging of products. A further aim of the present invention is to provide a packaging apparatus and process that facilitate evacuation of gas from a package while minimizing or eliminating evaporation of fluids from the product and/or from inside the package, and the evacuation of evaporated fluid. In particular, it is an aim of the invention to provide a packaging apparatus capable of executing the packaging process of the invention.

SUMMARY OF INVENTION

According to the invention, in a 1$^{st}$ aspect there is provided a packaging process comprising providing an evacuation station having a first chamber, a second chamber, and a dividing wall, the dividing wall separating the first chamber from the second chamber and having a gap fluidly connecting the first chamber and the second chamber, the gap having a size, the second chamber being fluidly connected to a vacuum source configured to apply a controlled vacuum pressure to the second chamber, the evacuation station being provided with a control unit configured to control the vacuum source; providing a package containing a product to be packaged, the package being made from a film and having an open end; arranging the package in the evacuation station such that a terminal portion of the open end is positioned within the second chamber, a non-terminal portion of the open end and the product are positioned within the first chamber, and an intermediate portion of the open end passes through the gap; the intermediate portion extending between the terminal portion and the non-terminal portion of the open end, the open end putting an inner volume of the package in fluid communication with an inner volume of the second chamber; controlling, by the control unit, a pressure differential between a first internal pressure in the first chamber and a second internal pressure in the second chamber to cause aspiration of gas from the inner volume of the package.

In a 2$^{nd}$ aspect according to the preceding aspect, the step of controlling the pressure differential comprises increasing the pressure differential, the step of increasing the pressure differential including one or more of controlling the vacuum source to decrease an absolute pressure value of the controlled vacuum pressure applied to the second chamber; and decreasing the size of the gap.

In a 3$^{rd}$ aspect according to any one of the preceding aspects, the step of controlling the pressure differential comprises decreasing the pressure differential, the step of decreasing the pressure differential including one or more of controlling the vacuum source to maintain or increase an absolute pressure value of the controlled vacuum pressure applied to the second chamber; and increasing the size of the gap.

In a 4$^{th}$ aspect according to any one of the preceding aspects, controlling the pressure differential comprises one or more of increasing the pressure differential during a first evacuation phase; and decreasing the pressure differential during a second evacuation phase.

In a 5$^{th}$ aspect according to the preceding aspect, the first evacuation phase precedes the second evacuation phase; and/or an end of the first evacuation phase is determined by the pressure differential reaching a predetermined maximum value; and/or controlling the pressure differential comprises substantially maintaining a current value of the pressure differential during an intermediate evacuation phase, the intermediate evacuation phase following the first evacuation phase and preceding the second evacuation phase.

In a 6$^{th}$ aspect according to any one of the preceding aspects, controlling the pressure differential comprises a plurality of steps of increasing and/or decreasing the pressure differential.

In a 7$^{th}$ aspect according to any one of the preceding aspects, controlling the pressure differential comprises providing the gap with a first size during an initial evacuation phase; providing the gap with a second size during a transitional evacuation phase; and providing the gap with a third size during a final evacuation phase; wherein the initial evacuation phase, the transitional evacuation phase, and the final evacuation phase are performed in sequence, the second size being smaller than the first and third sizes.

In an 8$^{th}$ aspect according to any one of the preceding aspects, the evacuation station is provided with a first pressure sensor configured to generate a first pressure signal indicative of the first internal pressure present in the first chamber; and a second pressure sensor configured to generate a second pressure signal indicative of the second internal pressure present in the second chamber; and wherein the control unit is further configured for receiving the first pressure signal and the second pressure signal; and determining the pressure differential based on the first pressure signal and the second pressure signal.

In a 9$^{th}$ aspect according to any one of the preceding aspects, the gap is provided with an elongated shape, optionally the elongated gap extending substantially parallel to a bottom plane of the first chamber configured to receive a package positioned in the evacuation station.

In a 10$^{th}$ aspect according to any one of the preceding aspects, the control unit is configured to control the pressure differential to not exceed an absolute value of about 300 mbar, preferably of about 250 mbar, more preferably of about 200 mbar.

In an 11$^{th}$ aspect according to any one of the preceding aspects, arranging the package in the evacuation station further comprises opening the first chamber; introducing the open end of the package into the gap along a length of the gap and positioning the package within the first chamber, such that the terminal portion of the open end is positioned within the second chamber, the non-terminal portion of the open end and the product are positioned within the first chamber, and the intermediate portion of the open end passes through the gap; and closing the first chamber.

In a 12$^{th}$ aspect according to any one of aspects 1 to 10, arranging the package in the evacuation station further comprises opening the first chamber, the second chamber, and the gap; positioning the terminal portion of the open end within the second chamber; positioning the non-terminal portion of the open end and the package within the first chamber; positioning the intermediate portion of the open end in superposition with the opened gap; closing the gap, the first chamber, and the second chamber.

In a 13$^{th}$ aspect according to any one of the preceding aspects, the process further comprises determining a vacuumization condition of the package and sealing the package, optionally the step of determining the vacuumization condition of the package preceding the step of sealing the package.

In a 14$^{th}$ aspect according to any one of the preceding aspects, the control unit is further configured to determine the vacuumization condition when the first internal pressure is at or below a predetermined target value, optionally the predetermined target value being about 20 mbar or less, preferably about 10 mbar or less, more preferably about 5 mbar or less.

In a 15$^{th}$ aspect according to any one of the preceding aspects, the control unit is further configured to determine a steaming condition of the package; and determine the vacuumization condition when the steaming condition of the package is determined.

In a 16$^{th}$ aspect according to the preceding aspect, the control unit is further configured to determine the steaming condition when, during the step of controlling the pressure differential the inner volume of the package increases for a time period of 50 msec or longer, preferably 100 msec or longer, more preferably 200 msec or longer, or the inner volume of the package increases by an amount of 2% or more, preferably by an amount of 3% or more, more preferably by an amount of 5% or more, the amount being measured as a percentage of the inner volume of the package based on the first internal pressure.

In a 17$^{th}$ aspect according to any one of the two preceding aspects, the control unit is further connected to a third sensor configured to emit a control distance signal indicative of a control distance between the third sensor and a portion of the film and wherein the control unit is further configured to determine the steaming condition when, during the step of controlling the pressure differential the control distance decreases by an amount of 2% or more, preferably by an amount of 3% or more, more preferably by an amount of 5% or more with respect to a current maximum control distance, the current maximum control distance being determined based on the control distance signal; optionally wherein the third sensor includes an electromagnetic sensor, preferably wherein the third sensor includes an optical sensor or an ultrasound sensor.

In an 18$^{th}$ aspect according to any one of the preceding aspects, the control unit is further connected to one or more actuators configured to provide the gap with at least a first size and a second size in response to corresponding control signals provided by the control unit, the first size and the second size being different from one another.

In a 19$^{th}$ aspect according to the preceding aspect, the one or more actuators are configured to act upon respective one or more spacers configured to abut a contact portion of a first portion, optionally wherein the one or more actuators are configured to shift and/or rotate the respective one or more spacers between a first configuration and a second configuration in response to the corresponding control signals provided by the control unit. In an additional aspect according to aspect 19, the dividing wall includes the first portion and a second portion, optionally wherein the first portion includes an upper portion based on a use configuration of the evacuation station and/or wherein the second portion includes a lower portion based on a use configuration of the evacuation station.

In a 20$^{th}$ aspect according to the preceding aspect, the first configuration includes a respective spacer to be in a retracted position and the second configuration includes the respective spacer to be in an extended position, optionally wherein an abutment surface of the respective spacer is configured to protrude from the second portion and abut the contact portion in the second configuration and/or wherein the abutment surface of the respective spacer is configured to not protrude from the second portion in the first configuration.

In a 21$^{st}$ aspect according to aspect 15 or according to any one of the preceding aspects in combination with aspect 15, the control unit is connected to an inlet valve, the inlet valve being arranged on an inlet line configured to put the first chamber into fluid communication with an ambient atmosphere or with a source of pressurized air, and wherein the control unit is configured to provide the first chamber with an increase in the first internal pressure by controlling the inlet valve, optionally the increase in pressure ranging from about 5 mbar to about 100 mbar, preferably from about 5 mbar to about 50 mbar.

In a 22$^{nd}$ aspect according to any one of the preceding aspects, the control unit is configured to control the pressure differential according to a predetermined pressure profile including a plurality of pressure values over time, wherein the pressure profile is selected such as to aspirate both gas from the second chamber and from inside the package through the gap.

In a 23$^{rd}$ aspect according to the preceding aspect, the pressure profile includes an initial pressure value, optionally the initial pressure value being equal to about ambient pressure, and/or the pressure profile includes a final pressure value, optionally the final pressure value being lower than the initial pressure value, further optionally the final pressure value being about 20 mbar or less, preferably about 10 mbar or less, more preferably about 5 mbar or less.

In a 24$^{th}$ aspect according to any one of the preceding aspects, sealing the package comprises creating a seal on the package at the open end, thereby forming a sealed package containing the product and having a sealed end; optionally the step of creating the seal on the package being performed when aspirating gas from inside the package and gas from the first chamber through the gap has been substantially concluded.

In a 25$^{th}$ aspect according to of any one of the preceding aspects, the step of providing the package comprises positioning a tubular film around the product to be packaged, and creating, at a sealing station, a first seal on the tubular film, thereby forming the package containing the product to be packaged, and optionally creating a longitudinal seal along the film in order to obtain the tubular film.

In a 26$^{th}$ aspect according to the preceding aspect, the process further comprises, before the step of sealing the package, the step of flushing the inside of the package with gas or a mixture of gases; optionally wherein the gas or mixture of gases comprise an inert gas; further optionally wherein the gas substantially consist of or comprises $CO_2$.

In a 27$^{th}$ aspect according to of any one of the preceding aspects, the process further comprises providing the gap with a size of 8 to 20 times of a thickness of the film; or providing the gap with a size of 2.0 mm or less, preferably 1.5 mm or less, more preferably 1.0 mm or less, most preferably 0.5 mm or less; or providing the gap with a size of between 0.2 mm and 2.0 mm, preferably between 0.3 mm and 1.5 mm, more preferably between 0.4 mm and 1.0 mm, most preferably between 0.4 mm and 0.5 mm.

In a 28$^{th}$ aspect according to any one of the preceding aspects, the process further comprises providing the inside of the film and/or the package with a protective gas, optionally the protective gas substantially comprising of $CO_2$.

In an additional aspect according to any one of the preceding aspects, the process further comprises the step of controlling, by the control unit, the vacuum source to provide the second chamber with the controlled vacuum pressure.

In a 29$^{th}$ aspect, there is provided a device for evacuating gas from a package in a packaging apparatus, the device comprising a first chamber, a second chamber; and a dividing wall separating the first chamber from the second chamber and having a gap fluidly connecting the first and second chambers, the gap having a size; wherein the device is configured to receive a package containing a product to be packaged, the package being made from a film and having an open end, the open end having a terminal portion, a non-terminal portion, and an intermediate portion located between the terminal portion and the non-terminal portion of the open end, the device being configured to receive the package such that a terminal portion of the open end is positioned within the second chamber, a non-terminal portion of the open end and the product are positioned within the first chamber, and an intermediate portion of the open end passes through the gap, the intermediate portion extending between the terminal portion and the non-terminal portion of the open end, the open end putting an inner volume of the package in fluid communication with an inner volume of the second chamber; the device further comprising a vacuum source fluidly connected to the second chamber and configured to apply a controlled vacuum pressure to the second chamber; a control unit configured for controlling the vacuum source, wherein the control unit is configured to perform the step of controlling a pressure differential between a first internal pressure in the first chamber and a second internal pressure in the second chamber, the pressure differential being controlled to cause aspiration of gas from the inner volume of the package.

In a 30$^{th}$ aspect according to the preceding aspect, the control unit is further configured for receiving the respective signals from the first and second pressure sensors indicative of the respective first and second internal pressures in the first and second chambers; and controlling the pressure differential based on the first and second internal pressures in the first and second chambers.

In a 31$^{st}$ aspect according to any one of aspects 29 to 30, the step of controlling the pressure differential comprises increasing the pressure differential, the step of increasing the pressure differential including one or more of controlling the vacuum source to decrease an absolute pressure value of the controlled vacuum pressure applied to the second chamber; and decreasing the size of the gap.

In a 32$^{nd}$ aspect according to any one of aspects 29 to 31, the step of controlling the pressure differential comprises decreasing the pressure differential, the step of decreasing the pressure differential including one or more of controlling the vacuum source to maintain or increase an absolute pressure value of the controlled vacuum pressure applied to the second chamber; and increasing the size of the gap.

In a 33$^{rd}$ aspect according to any one of aspects 29 to 32, controlling the pressure differential comprises one or more of increasing the pressure differential during a first evacuation phase; and decreasing the pressure differential during a second evacuation phase.

In a 34$^{th}$ aspect according to the preceding aspect, the first evacuation phase precedes the second evacuation phase; and/or an end of the first evacuation phase is determined by the pressure differential reaching a predetermined maximum value; and/or controlling the pressure differential comprises substantially maintaining a current value of the pressure differential during an intermediate evacuation phase, the intermediate evacuation phase following the first evacuation phase and preceding the second evacuation phase.

In a 35$^{th}$ aspect according to any one of aspects 29 to 34, controlling the pressure differential comprises a plurality of steps of increasing and/or decreasing the pressure differential.

In a 36$^{th}$ aspect according to any one of aspects 29 to 35, controlling the pressure differential comprises providing the gap with a first size during an initial evacuation phase; providing the gap with a second size during a transitional evacuation phase; and providing the gap with a third size during a final evacuation phase; wherein the initial evacuation phase, the transitional evacuation phase, and the final evacuation phase are performed in sequence, the second size being smaller than the first and third sizes.

In a 37$^{th}$ aspect according to any one of aspects 29 to 36, the gap is provided with an elongated shape, optionally the elongated gap extending substantially parallel to a bottom plane of the first chamber configured to receive a package positioned in the evacuation station.

In a 38$^{th}$ aspect according to any one of aspects 29 to 37, the control unit is further configured to control the pressure differential to not exceed an absolute value of about 300 mbar, preferably of about 250 mbar, more preferably of about 200 mbar.

In a 39$^{th}$ aspect according to any one of aspects 29 to 38, the first chamber is configured to open and close, and wherein the first chamber is further configured to allow the open end of the package to be introduced into the gap along a length of the gap and the package to be positioned within the first chamber, such that the terminal portion of the open end is positioned within the second chamber, the non-terminal portion of the open end and the product are positioned within the first chamber, and the intermediate portion of the open end passes through the gap.

In a 40$^{th}$ aspect according to any one of aspects 29 to 39, the first chamber, the second chamber, and the gap are configured to open and close, and wherein the first chamber, the second chamber, and the gap are further configured to allow for the terminal portion of the open end to be positioned within the second chamber; the non-terminal portion of the open end and the package to be positioned within the first chamber; and the intermediate portion of the open end to be positioned in superposition with the opened gap.

In a 41$^{st}$ aspect according to any one of aspects 29 to 40, the control unit is further configured to determine a vacuumization condition of the package and control sealing of the package, optionally the step of determining the vacuumization condition of the package preceding the step of sealing the package.

In a 42$^{nd}$ aspect according to aspect 41, the control unit is further configured to determine the vacuumization condition when the first internal pressure is at or below a predetermined target value, optionally the predetermined target value being about 20 mbar or less, preferably about 10 mbar or less, more preferably about 5 mbar or less.

In a 43$^{rd}$ aspect according to any one of aspects 41 to 42, the control unit is further configured to determine a steaming condition of the package; and determine the vacuumization condition when the steaming condition of the package is determined.

In a 44$^{th}$ aspect according to the preceding aspect, the control unit is further configured to determine the steaming condition when, during the step of controlling the pressure differential the inner volume of the package increases for a time period of 50 msec or longer, preferably 100 msec or longer, more preferably 200 msec or longer, or the inner volume of the package increases by an amount of 2% or more, preferably by an amount of 3% or more, more preferably by an amount of 5% or more, the amount being measured as a percentage of the inner volume of the package based on the first internal pressure.

In a 45$^{th}$ aspect according to any one of the two preceding aspects, the control unit is further connected to a third sensor configured to emit a control distance signal indicative of a control distance between the third sensor and a portion of the film and wherein the control unit is further configured to determine the steaming condition when, during the step of controlling the pressure differential the control distance decreases by an amount of 2% or more, preferably by an amount of 3% or more, more preferably by an amount of 5% or more with respect to a current maximum control distance, the current maximum control distance being determined based on the control distance signal; optionally wherein the third sensor includes an electromagnetic sensor, preferably wherein the third sensor includes an optical sensor or an ultrasound sensor.

In a 46$^{th}$ aspect according to any one of aspects 29 to 45, the control unit is further connected to one or more actuators configured to provide the gap with at least a first size and a second size in response to corresponding control signals provided by the control unit, the first size and the second size being different from one another.

In a 47$^{th}$ aspect according to any one of aspects 29 to 46, the one or more actuators are configured to act upon respective one or more spacers configured to abut a contact portion of a first portion, optionally wherein the one or more actuators are configured to shift and/or rotate the respective one or more spacers between a first configuration and a second configuration in response to the corresponding control signals provided by the control unit. In an additional aspect according to aspect 47, the dividing wall includes the first portion and a second portion, optionally wherein the first portion includes an upper portion based on a use configuration of the evacuation station and/or wherein the second portion includes a lower portion based on a use configuration of the evacuation station.

In a 48$^{th}$ aspect according to any one of aspects 29 to 47, the first configuration includes a respective spacer to be in a retracted position and the second configuration includes the respective spacer to be in an extended position, optionally wherein an abutment surface of the respective spacer is configured to protrude from the second portion and abut the contact portion in the second configuration and/or wherein the abutment surface of the respective spacer is configured to not protrude from the second portion in the first configuration.

In a 49$^{th}$ aspect according to aspect 43 or according to any one of aspects 29 to 48 in combination with aspect 43, wherein the control unit is connected to an inlet valve, the inlet valve being arranged on an inlet line configured to put the first chamber into fluid communication with an ambient atmosphere or with a source of pressurized air, and wherein the control unit is configured to provide the first chamber with an increase in the first internal pressure by controlling the inlet valve, optionally the increase in pressure ranging from about 5 mbar to about 100 mbar, preferably from about 5 mbar to about 50 mbar.

In a 50$^{th}$ aspect according to any one of aspects 29 to 49, the control unit is configured to control the pressure differential according to a predetermined pressure profile including a plurality of pressure values over time, wherein the pressure profile is selected such as to aspirate both gas from the second chamber and from inside the package through the gap.

In a 51$^{st}$ aspect according to any one of aspects 29 to 50, the pressure profile includes an initial pressure value, optionally the initial pressure value being equal to about ambient pressure, and/or the pressure profile includes a final pressure value, optionally the final pressure value being lower than the initial pressure value, further optionally the final pressure value being about 20 mbar or less, preferably about 10 mbar or less, more preferably about 5 mbar or less.

In a 52$^{nd}$ aspect according to any one of aspects 29 to 51, the device further comprises a sealing device configured for sealing the package, the sealing device being configured for creating a seal on the package at the open end, thereby forming a sealed package containing the product and having a sealed end; optionally the step of creating the seal on the package being performed when aspirating gas from inside the package and gas from the first chamber through the gap has been substantially concluded.

In a 53$^{rd}$ aspect according to any one of aspects 29 to 52, the gap is provided with a size of 8 to 20 times of a thickness of the film; or the gap is provided with a size of 2.0 mm or less, preferably 1.5 mm or less, more preferably 1.0 mm or less, most preferably 0.5 mm or less; or the gap is provided with a size of between 0.2 mm and 2.0 mm, preferably between 0.3 mm and 1.5 mm, more preferably between 0.4 mm and 1.0 mm, most preferably between 0.4 mm and 0.5 mm.

In a 54$^{th}$ aspect according to any one of aspects 29 to 53, the inside of the film and/or the package is provided with a protective gas, optionally the protective gas substantially comprising of $CO_2$.

In a 55$^{th}$ aspect according to any one of aspects 29 to 54, the control unit is programmed for controlling the evacuation means to create an internal vacuum pressure of between 1 mbar and 20 mbar, preferably between 3 mbar and 10 mbar, most preferably of about 5 mbar.

In a 56$^{th}$ aspect according to any one of aspects 29 to 55, the control unit is further configured to control the vacuum source to provide the second chamber with the controlled vacuum pressure.

In a 57$^{th}$ aspect, there is provided a packaging apparatus comprising an evacuation station coupled to the control unit, and an output station; wherein the evacuation station comprises a device for evacuating according to any one of aspects 29 to 56.

In a 58$^{th}$ aspect according to the preceding aspect, the apparatus further comprises a flusher configured for flushing, prior to sealing the package, the inside of the package with gas or a mixture of gases; optionally wherein the gas or mixture of gases comprise an inert gas; further optionally wherein the gas substantially consist of or comprises $CO_2$. Advantages of the packaging process and the packaging apparatus include that evacuation of gas/air from a package is performed in an effective and efficient manner.

Advantages of the packaging process and the packaging apparatus further include that evacuation of gas/air from a package is performed efficiently while minimizing or eliminating evaporation of fluids from the product and/or from inside the package, and/or minimizing or eliminating the evacuation of evaporated fluid. The above is also referred to as minimizing or eliminating of steaming and its effects.

Advantages of the packaging process and the packaging apparatus further include that an evacuation process can be modified in order to adapt to a wide range of product and/or package properties, for example product type, consistency, size, shape, etc. and package type, size, shape, material, etc. In particular, the evacuation process can be modified in order to control an evacuation rate during different stages of evacuation, especially in the final stages during which steaming is likely to occur.

Advantages of the packaging process and the packaging apparatus also include that a pressure differential between a first and a second chamber can be controlled in order to effectively and/or efficiently evacuate a package. Controlling the pressure differential can include increasing and/or decreasing the pressure differential one or more times during evacuation.

Advantages of the packaging process and the packaging apparatus further include that the risk of deterioration of the products (e.g. molding caused by residual oxygen) can be reduced or eliminated by providing the packages with a protective gas, prior to evacuation of gas or air.

The packaging process may also facilitate full integration and automation with a horizontal form, fill, and seal (HFFS) apparatus.

DETAILED DESCRIPTION

Figure 1:
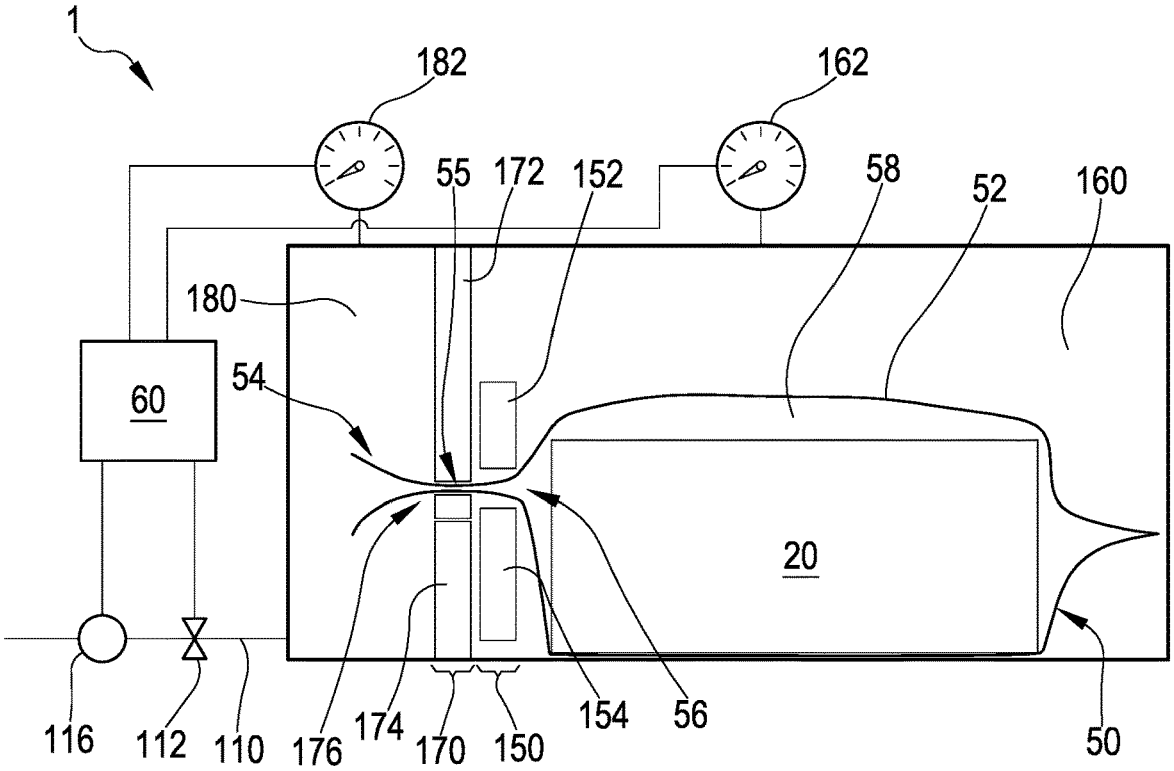
FIG. 1 shows a schematic cross section view of a first embodiment of an evacuation station of a packaging apparatus according to the present invention, the package being shown in a state prior to evacuation.
Figure 2:
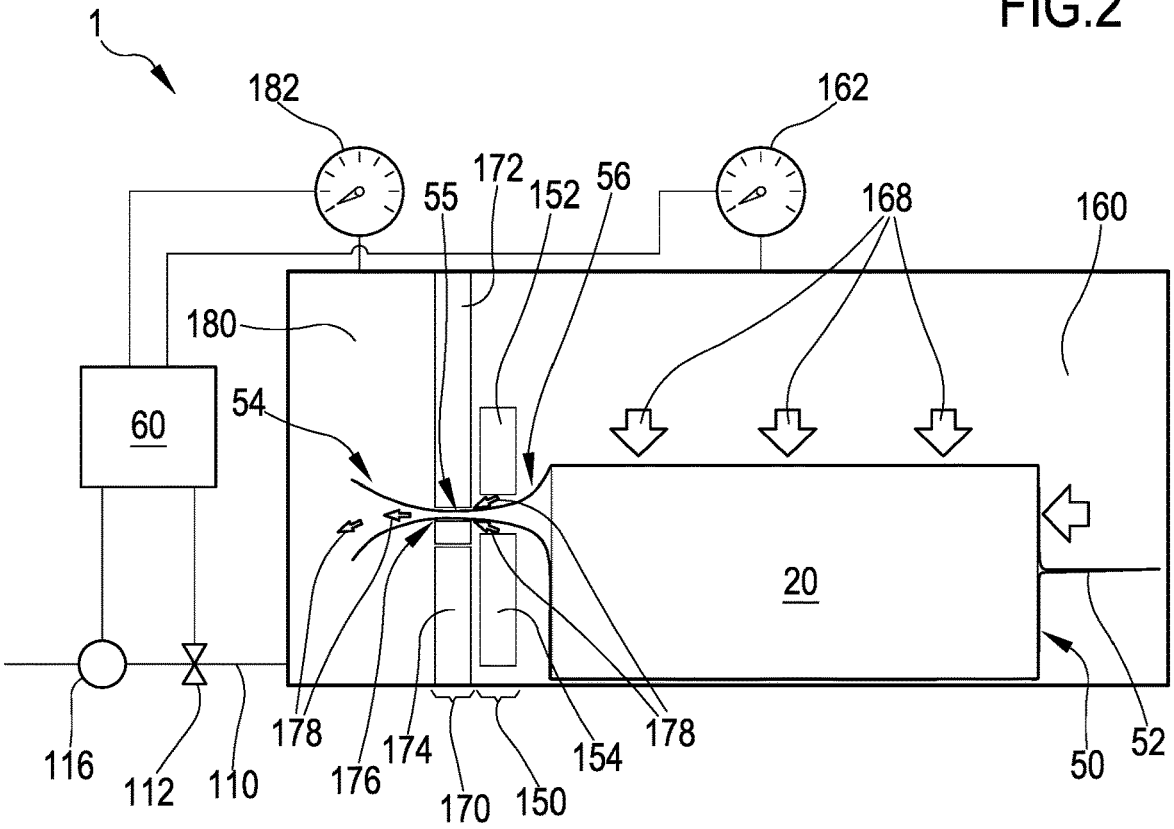
FIG. 2 shows a schematic cross section view of the first embodiment shown in FIG. 1, the package being shown in a state during evacuation.

FIG. 1 shows a schematic cross section view of a first embodiment of an evacuation station of a packaging apparatus according to the present invention, the package being shown in a state prior to evacuation. The evacuation station 1 generally comprises a first chamber 160 and a second chamber 180. The first chamber 160 is configured to house or accommodate a package 50 containing a product 20 to be packaged. The second chamber 180 is in fluid communication with the first chamber 160 through a gap 176. The gap 176 can be a gap having an adjustable size or a fixed size, depending on the individual embodiment. The first embodiment described in FIGS. 1 and 2 is provided with an adjustable gap 176. The size of the adjustable gap 176 can be adjusted, for example, by adjusting a height or width of the gap 176 as is described in more detail further below. It is noted that the terms "height" or "width" refer to a use condition of the evacuation station, providing concrete examples of how the size of a gap 176 can be adjusted. None of these terms is intended to limit the manner in which the adjustment is provided. It is further noted that adjusting the size of a gap 176 includes adjusting an area of an opening defined by the gap 176. An elongated gap 176, for example as shown in FIGS. 1 and 2 (cross section) or in FIGS. 3A and 3B (isometric view) is configured allow modification of a distance between opposite edges delimiting the gap 176, thereby allowing for adjusting the size of the gap 176.

A dividing wall 170 separates the first and second chambers from one another, except for the gap 176. Generally, the adjustable gap 176 (or a fixed gap in corresponding embodiments) can be provided with a gasket (not shown in FIG. 1; see, e.g., gasket 172*g* in FIG. 1B as described further below) configured to allow for a controlled fluid flow in the presence of a pressure difference. The gasket may be configured to minimize or significantly reduce a pressure exerted by portions 172 and 174 of the dividing wall 170 on film material extending through the gap. Here, the pressure exerted by the gasket is configured to be high enough in order to sufficiently seal the gap 176 with respect to the packaging material and in order to prevent an excessive gas flow from the first chamber 160 to the second chamber 180, the gas flow being external to the package 50. At the same time, the pressure exerted by the gasket is configured to be low enough in order to allow for a sufficient flow of gas from the inner volume 58 of the package 50 through the adjustable (or fixed) gap 176.

The first chamber 160 is provided with a pressure sensor 162 and the second chamber 180 is provided with a pressure sensor 182. Both pressure sensors are connected to a control unit 60 and are configured to provide the control unit 60 with a respective control signal indicative of a corresponding pressure in the first and second chambers, respectively. The control unit 60 is configured to receive the control signals from the sensors and to process the signals in an evacuation process (e.g. involving controlling a vacuum pump 116 to supply a vacuum pressure and/or to increase or decrease the vacuum pressure).

The evacuation station further comprises a vacuum pump 116 optionally with a booster (not shown) and a control valve 112. The vacuum pump 116 and control valve 112 are connected to the second chamber 180 by a vacuum line 110 configured to evacuate the second chamber by putting the vacuum pump 116 and the second chamber 180 into fluid communication with one another. The vacuum pump 116 and the control valve 112 are connected to the control unit 60 and configured to receive control signals from the control unit 60. This allows the control unit 60 to control the vacuum pump 116 (e.g. by increasing/decreasing a power supplied to the pump or by sending a control signal controlling a motor driving the pump at a higher or lower rate) and/or the control valve 112 (e.g. by selectively controlling the valve to at least partially or fully open or close the line 110). The control valve can be a servo-type control valve or any other control valve configured to gradually or proportionally open and close a fluid connection. The control valve may include components configured to move between a first position, in which the fluid connection is fully open (e.g. fully unrestricted fluid flow; 100% open), a second position, in which the fluid connection is fully closed (e.g. fully restricted or blocked fluid flow; 0% open), and one or more intermediate positions in which the fluid connection is partially open (e.g. partially restricted fluid flow; for example 20%, 50%, or 68% open). The control unit 60 is configured to control one or more different components (e.g. pump 116, valve 112) based on an evacuation process and depending upon signals received from one or more different sensors (e.g. sensors 162, 182). Some embodiments do not exhibit a control valve and/or a booster. It is understood that alternative components and/or arrangements can be employed in order to supply a vacuum to the evacuation station 1.

The dividing wall is provided with an adjustable gap 176, defined by a first (e.g. upper) portion 172 of the dividing wall 170 and a second (e.g. lower) portion 174 of the dividing wall. In the first embodiment, the first portion 172 of the dividing wall 170 is vertically adjustable, thereby facilitating adjusting of the size of the gap 176. To this aim, the first portion 172 is provided with an actuator (not shown) configured to vertically move (e.g. shift, extend, retract) the first portion 172. The actuator can be connected to the control unit 60 in order for the control unit 60 to control the actuator in accordance with an evacuation process executed by the control unit 60. It is understood that in other embodiments, the gap 176 can be provided with an adjustable size in alternative ways, for example involving the second portion 174 being vertically adjusted (e.g. moved, shifted, extended, retracted) using a corresponding actuator. In still other embodiments, both the first and the second portion can be adjustable (e.g. vertically), and/or further adjustments may be implemented, for example adjustment of the height of the gap 176 in the dividing wall 170 by adjusting both first and second portions 172 and 174 in the same manner (e.g. shifting up or down, extending and/or retracting). The gap 176 has a generally elongated development, extending along the first and second portions 172 and 174 and transversally through the first chamber 160. In some embodiments (see, e.g., FIG. 1B) the gap can be provided with a flexible gasket, configured to seal the (adjustable or fixed) gap to a certain degree (see above). In still further embodiments, the gasket may be configured to expand or contract due to an internal pressure (e.g. pneumatic, hydraulic), thereby adjusting the tightness of the seal provided by the gasket.

At least the first chamber 160 is configured to open and close in order to allow for a package 50 (containing a product 20 to be packaged) to be introduced into the first chamber 160 for evacuation and for it to be removed from the first chamber 160 after evacuation. This can be achieved by providing the evacuation station 1 and/or the first chamber 160 and, optionally, the second chamber 180 with upper and lower portions (not explicitly shown) configured to provide the evacuation station 1 and/or the first chamber 160 and, optionally, the second chamber 180 with an opening/closing mechanism. It is understood that other alternatives exist (e.g. hinge mechanisms, hatch mechanisms, etc.) which can be employed here.

In some embodiments, only the first chamber 160 is configured to open independently from the second chamber. In these embodiments, the second chamber can be configured to remain closed and to present the gap 176 as an elongated opening into which the bag neck of a package 50 can be introduced, for example laterally. In order to insert a package 50, the first chamber 160 is opened based on one of the mechanisms mentioned above. Then, the package 50 is placed into the first chamber 160 in a manner that allows for the bag neck of the package 50 to be introduced/inserted into the gap 176 presented by the second (closed) chamber 180. Finally, the first chamber 160 is closed again and the evacuation process can be started. This embodiment may entail advantages in providing the back neck (e.g. an intermediate portion of the open end of the package) with wrinkles during the insertion of the back neck into the gap 176. This can be achieved by providing smooth or cogged wheels/belts configured to introduce the intermediate portion of the open end of the package 50 into the gap 176. Wrinkles provided in the bag neck in this manner may facilitate a more effective evacuation and/or substantially improve vacuumization of the package 50.

In other embodiments, both the first and second chambers 160 and 180 are configured to open and close, for example based on a joint mechanism configured to open and close the entire evacuation station 1. In these embodiments, the gap 176 is also configured to open in the sense that, for example, the first (e.g. upper) portion 172 of the dividing wall 170 can be configured to be lifted upwards and/or away from the second (e.g. lower) portion 174 of the dividing wall 170, thereby allowing for easy placement of the package 50 within the first chamber 160 and of the bag neck of the package 50 within the gap 176. In order to insert a package 50, the first and second chambers 160 and 180 are opened based on one of the mechanisms mentioned above. Then, the package 50 is placed into the first chamber 160 and the bag neck of the package 50 is placed in the proximity of the gap 176 (e.g. above or on the second portion 174 of the dividing wall 170). Finally, the first and second chambers 160 and 180 are closed again, thereby enclosing the bag neck of the package 50 within the gap 176 (e.g. between the first and second portions 172 and 174 of the dividing wall 170) and the evacuation process can be started.

It is noted that the individual manner in which the packages 50 are placed into the evacuation station 1 and the individual mechanisms for opening/closing the evacuation station 1, the first chamber 160, and/or the second chamber 180, may be selected based on the individual application and based on the properties of the packages 50 and/or of the products 20.

The package 50 is made from packaging film 52 and has the shape of an open bag having an open end and a closed end. The bag contains the product 20 and is shown in FIG. 1 in a stat prior to evacuation, i.e. with the packaging film 52 not closely adhering to the product 20, thereby indicating that residual gas or air is present within the package 50, for example in an inner volume 58. The inner volume 58 includes at least the volume inside the packaging film 52 and around the product 20, but also volumes of gas/air contained, enclosed, or otherwise within the product 20 itself (e.g. in case of cheese having holes, vegetables such as broccoli or cauliflower, somewhat porous products, or other products comprising cavities capable of housing gas/air).

The package 50 is arranged within the first chamber 160 in such a manner that the open end extends from the first chamber 160 through the gap 176 and into the second chamber 180. During evacuation, therefore, an outer portion 54 of the open end is arranged in the second chamber 180, an inner portion 56 of the open end is arranged in the first chamber, and an intermediate portion 55 of the open end, located between the outer 54 and inner 56 portions, is arranged in the region of the gap 176. The inner volume within the package 50 is, thus, put into fluid communication with the inner volume of the second chamber 180 by the bag neck extending from the first chamber 160 through the gap 176 and into the second chamber 180.

Generally, the control unit 60 is configured to control the vacuum pump 116 and/or the control valve 112 in order to provide the second chamber 180 with a vacuum pressure below an ambient pressure. The vacuum pressure typically ranges from about or slightly below ambient pressure (at the beginning of evacuation) to about 1 to 20 mbar (upon completion of evacuation). In some embodiments, the target vacuum pressure ranges from about 1 mbar to about 20 mbar, preferably from about 1 mbar to about 10 mbar.

The vacuum pressure supplied to the second chamber 180 can be controlled by the control unit 60, for example by controlling a power supplied to the vacuum pump 116 (e.g. the power supplied to a motor driving the pump 116) and/or by controlling the valve 112 to selectively open or (at least partially) close. Further, the pressure in the second chamber 180 can be influenced by fluid flow (e.g. gas/air) from the first chamber 160 through the gap 176 and into the second chamber 180. Thus, the actual pressure in the second chamber 180 is a combined result from the pressure differential between the vacuum pressure applied to the second chamber 180 and controlled by the control unit 60 and from the amount of fluid flowing from the first chamber 160 through the gap 176 into the second chamber 180. The fluid flow from the first chamber 160 to the second chamber 180 substantially depends upon the pressure differential between the pressures in the first 160 and second 180 chambers, as well as on the properties of the gap 176 (e.g. size, shape) and upon the presence, type, and properties of a gasket (e.g. a lip-type gasket configured to provide a predetermined resistance to fluid flow through the gap 176). Further details with respect to different embodiments of adjustable gaps 176 are provided below in connection with FIGS. 1A, 1B, 1C, and 1D.

In order to evacuate a package 50, the control unit 60 controls different components (e.g. pumps, actuators) based on a control program supplied to the control unit 60 and configured to control the evacuation process. In this manner, the control unit 60 may control actuators (not shown) in order to open the evacuation station (e.g. open the first chamber 160) to facilitate placement of the package into the first chamber 160. Subsequently, the control unit 60 may control the actuators to close the evacuation station 1 (e.g. the first chamber 160).

The evacuation takes places based on a vacuum pressure applied to the evacuation station 1. The control unit 60 may control the pump 116 and/or the control valve 112 in order to provide the second chamber with a vacuum pressure in accordance with the control program being executed. In some embodiments, the control unit 60 is configured to supply a vacuum pressure to the second chamber based on the control signal supplied by the second pressure sensor 182 and/or in accordance with a predetermined pressure profile. The control unit 60 may be configured to monitor the pressure in the first 160 and/or second 180 chambers during evacuation in order to ensure compliance with the control program being executed.

Due to the vacuum pressure being supplied to the second chamber 180 (e.g. absolute pressure in the second chamber 180 being reduced), gas/air is also drawn from the first chamber 160 and, thus, the vacuum pressure is also supplied to the first chamber 160 (e.g. absolute pressure in the first chamber 180 also being reduced) because the adjustable gap 176 puts the second and first chambers 180 and 160 into fluid communication with one another. However, since the bag neck of the package 50 puts the inside of the package 50 also into fluid communication with the second chamber 180 and extends from the first chamber 160 into the second chamber 180 through the adjustable gap 176, the vacuum pressure in the second chamber 180 also causes gas/air to be drawn from the inside of the package 50, thereby supplying the vacuum pressure to the package 50 and, thus, evacuating the package 50.

Generally, the pressure in the second chamber 180 is lower than the pressure in the first chamber 160 during evacuation (e.g. while the absolute pressure in the second chamber is reduced). This is because the vacuum pressure is supplied to the second chamber 180, and the first chamber 160 is merely fluidly connected to the second chamber 180 by means of the adjustable gap 176. Here, at least two effects substantially determine a pressure differential between the first and second chambers 160 and 180.

One effect is based on the individual properties of the adjustable gap 176, for example the size, shape, and/or profile thereof. The gap 176 contributes to the pressure differential between the second chamber 180 and the first chamber 160 in that it provides a resistance to fluid flow (e.g. during evacuation of gas/air from the first chamber 160 to the second chamber 180, the fluid flow continuing onwards towards the valve 112 and/or the pump 116). The resistance to fluid flow depends on the properties of the gap 176. These properties may include, but are not limited to the size of the gap 176 (e.g. the height of an elongated opening), its shape (e.g. elongated, extending transversally through the evacuation station 1), and/or its profile (e.g. shape variations along the direction of fluid flow and/or along a main development direction of the elongated opening). Generally, a larger gap 176 contributes to a lower pressure differential, while a smaller gap 176 contributes to a higher pressure differential. In some embodiments, the gap 176 presents an elongated opening having a height of about 0.2 mm to about 5 mm, preferably the opening has a height of about 0.4 mm to about 1 mm.

Another effect is based on the pressure gradient applied during evacuation. If the vacuum pressure is built up in a very short time (e.g. several 10ths of a second; when applying a high evacuation rate), the pressure differential between the first chamber 160 and the second chamber 180 is typically higher than in cases where the vacuum pressure is built up over a longer period of time (e.g. several seconds). The result, for example including a quality of evacuation (e.g. residual gas/air volume, vacuum pressure achieved), varies greatly depending upon the individual parameters of the evacuation process. It is desired to evacuate the package 50 in a short time and as much as possible while avoiding any losses due to evaporation of liquid from the product 20 (see above).

Figure 1A:
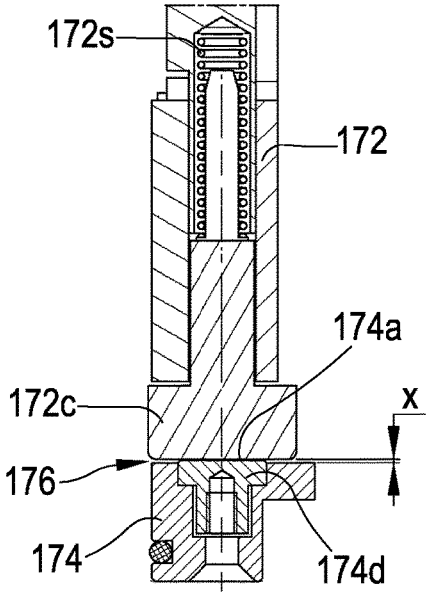
FIG. 1A shows a first embodiment of an adjustable gap mechanism in accordance with embodiments of the present invention.

FIG. 1A shows a first embodiment of an adjustable gap mechanism in accordance with embodiments of the present invention. In this first embodiment, the first portion 172 of the dividing wall 170 is provided with a contact portion 172*c* movably associated to the first portion 172. The contact portion 172*c* is preferably biased towards the second portion 174 using a biasing element 172*s*, for example a spring or other elastically deformable element capable of providing the contact portion 172*c* with a biasing force. The contact portion 172*c* is, thus, configured to move between a first position and a second position, the contact portion 172*c* being in an extended configuration relative to the first portion 172 in the first position and being in a retracted or compressed configuration relative to the first portion 172 in the second position. The biasing force is configured to bias the contact portion 172*c* towards the first position, such that in the absence of an external force, the contact portion 172*c* returns to or remains in the first position and, upon contact with the second portion 174 and/or spacers 174*d* (see below) moves towards and/or into the second position. This principle applies to the first, second, third, and fourth embodiments of the adjustable gap as shown in FIGS. 1A to 1D.

The second portion 174 is provided with one or more spacers 174*d* configured to maintain the contact portion 172*c* at a predefined distance X from the second portion 174 upon contact between the contact portion 172*c* with the one or more spacers 174*d*. The one or more spacers 174*d* are configured to provide the gap 176 with a predefined size (e.g. height X of the gap 176). To this aim, one or more spacers 174*d* are arranged and configured to abut the contact portion 172*c* so that a substantially uniform distance between the contact portion 172*c* and the second portion 174 is maintained along a length of the gap 176. In this configuration, one or more spacers 174*d* may be, preferably evenly, spaced along the length of the gap 176. Alternatively, one spacer 174*d* each may be substantially located proximate each respective end of the gap 176 (see example placement of spacer 174*d* as shown on the right in FIG. 1B), such that substantially the entire length of the gap 176 is free from spacers 174*d* and such that the contact portion 172*c* can contact and/or abut, proximate each end thereof, one of the spacers 174*d*.

Each spacer 174*d* may be adjustably associated to the second portion 174, thereby allowing a single spacer 174*d* to be adjusted towards the first portion 172 (i.e. in order to increase the size of the gap 176) or away from the first portion 172 (i.e. in order to decrease the size of the gap 176). This may be achieved by a suitable adjustment means, such as a screw engaging a thread provided in spacer 174*d*. Alternatively, the spacer 174*d* may itself include a thread engaging a corresponding thread provided in the second portion 174, such that the spacer 174*d* itself can be adjusted like a screw. Other adjustment means may be employed, too. For example, several different spacers 174*d* may be provided having configurations involving different spatial measurements (e.g. different sizes or lengths as measured from and in a direction normal to an abutment surface of the spacer 174*d*), in order to provide the gap 176 with a predetermined size. As can be seen from FIG. 1A, the spacer 174*d* may be provided with a top section that is thicker or thinner than the one shown, the thickness of the top section being measured in the same direction as the size X of the gap 176. A thicker top section may be employed to provide the gap 176 with a larger size (e.g. greater height X) while a thinner top section may be employed to provide the gap 176 with a smaller size (e.g. lower height X).

Figure 1B:
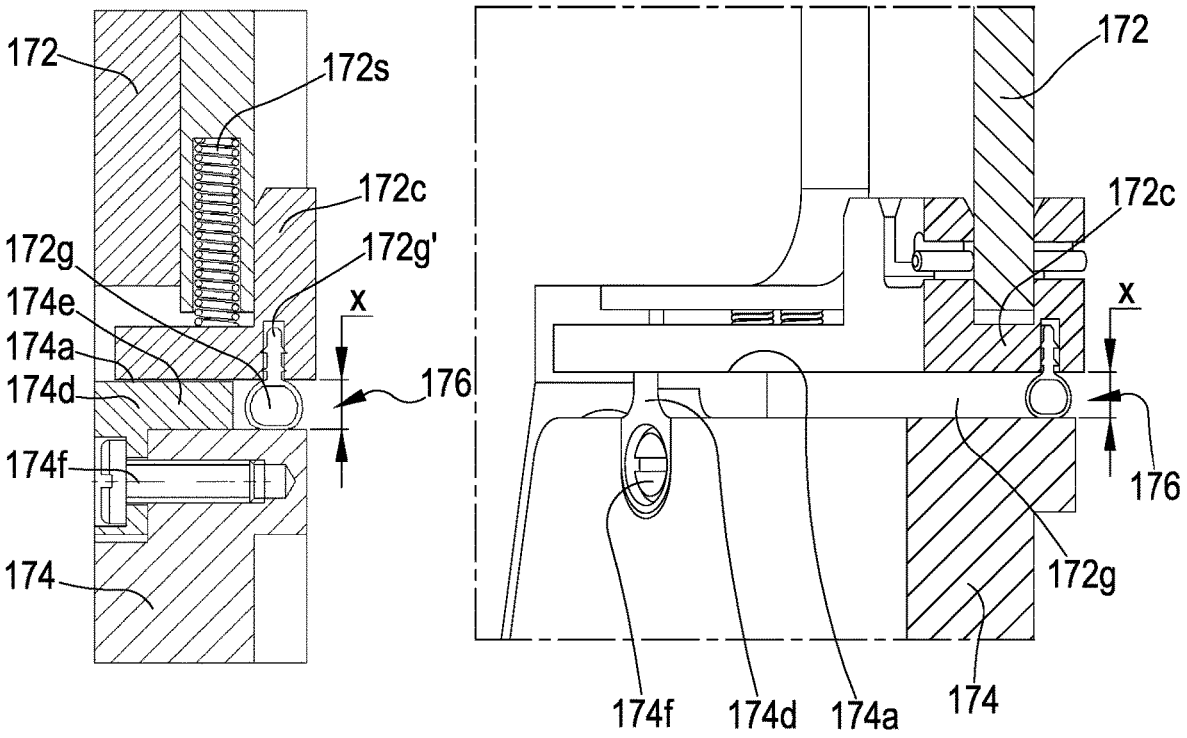
FIG. 1B shows a second embodiment of an adjustable gap mechanism in accordance with embodiments of the present invention.

FIG. 1B shows a second embodiment of an adjustable gap mechanism in accordance with embodiments of the present invention. This embodiment is similar to the embodiment shown in FIG. 1A in that the first portion 172 of the dividing wall 170 is also provided with a contact portion 172*c* movably associated to the first portion 172. The contact portion 172*c* is also biased towards the second portion 174 using a biasing element 172*s*, for example a spring or other elastically deformable element capable of providing the contact portion 172*c* with a biasing force. The second portion 174 is further provided with one or more spacers 174*d* configured to maintain the contact portion 172*c* at a predefined distance X from the second portion 174 upon contact between the contact portion 172*c* with the one or more spacers 174*d*.

Generally, the spacers 174*d* shown in FIG. 1B operate substantially similar to those shown in FIG. 1A and, thus, the particular arrangement of the spacers 174*d* as shown in FIG. 1A could be the same for the embodiment shown in FIG. 1B, or vice versa. In the embodiment shown in FIG. 1B, the one or more spacers 174*d* are attached to the second portion 174 in a different manner, employing attachment means 174*f* (e.g. screws laterally fixing spacers 174*d* to second portion 174) configured to fixedly attach the one or more spacers 174*d* to the second portion 174. In this embodiment, the specific configuration of the spacers 174*d* provides the gap 176 with a predefined size (e.g. height X of the gap 176) by means of extensions 174*e* configured to abut the contact portion 172*c* and, optionally, the second portion 174 of the dividing wall. The individual measurements (e.g. thickness) of the extension 174*e* can be designed to provide the gap 176 with a desired size (e.g. height X).

In contrast to the contact portion 172*c* shown in FIG. 1A, the contact portion 172*c* as shown in FIG. 1B is additionally configured to be provided with a gasket 172*g*. In the embodiment shown, the contact portion 172*c* is provided with a notch or channel configured to receive an attachment portion 172*g*' of the gasket 172*g*. However, the gasket 172*g* may be associated to the contact portion 172 in another suitable manner (e.g. using other attachment means, such as glue, pins, screws, or similar).

The gasket 172*g* is generally configured to extend along a length of the gap 176 from a first end of the first and second portions 174 and 172 to a respective opposite second end thereof. The gasket 172*g* is generally configured to control a pressure exerted upon film material extending through the gap 176, the exerted pressure substantially controlling the gas flow from the first chamber 160 to the second chamber 180 and/or from the package 50 to the second chamber 180. An excessively high or low gas flow from the first chamber 160 to the second chamber (i.e. the gas flowing externally along the packaging material from one chamber to the other through the gap 176), is potentially detrimental to the vacuumization process and, in addition, may impede keeping opposing layers of film at the open end of a package apart from each other. An excessively high or low gas flow from the package 50 to the second chamber (i.e. the gas flowing from the inside of the package 50 to the second chamber 180 through the gap 176), is potentially detrimental to the vacuumization process. In particular, it is desired to reduce the time required for vacuumization and to achieve a low residual amount of air/gas in the package after vacuumization.

The pressure exerted by the gasket is configured to enable a sufficient flow of gas from the inner volume 58 of the package 50 through the gap 176 and into the second chamber 180, while at the same time allowing a sufficient flow of gas from the first chamber 160 through the gap 176 and into the second chamber 180. The gas flow can be controlled to be within desired ranges, for example, by modifying the properties of the gasket 172*g* (e.g. elasticity, size, shape, profile, thickness, etc.). Also, an inner volume within gasket 172*g* may be subjected to a fluid under positive pressure as compared to an ambient pressure (e.g. by applying a flow of pressurized air to the inside of the gasket). By controlling the pressure of the fluid thus applied, the pressure exerted by the gasket can be controlled dynamically during the evacuation process. The gas flow can further be controlled by the size of the gap 176. These process parameters can be modified depending upon the concrete application (e.g. depending upon the properties of the film material used for packaging, the type and size of products being packaged, the size of the packages, etc.).

Figure 1C:
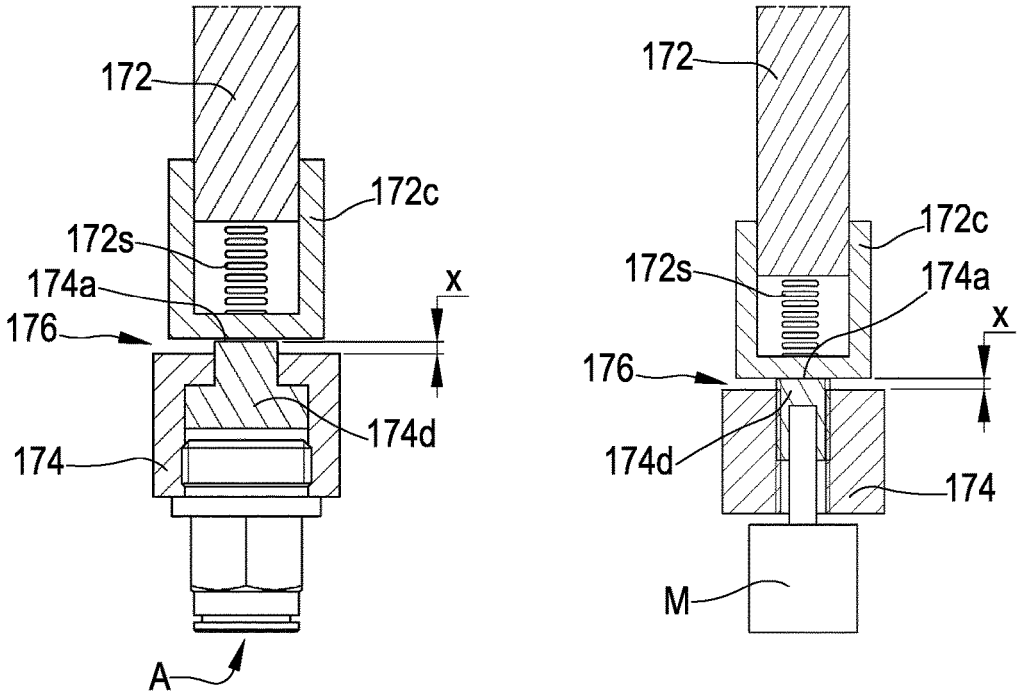
FIG. 1C shows a third embodiment of an adjustable gap mechanism in accordance with embodiments of the present invention.

FIG. 1C shows a third embodiment of an adjustable gap mechanism in accordance with embodiments of the present invention. This embodiment is similar to the embodiment shown in FIGS. 1A and 1B in that the first portion 172 of the dividing wall 170 is also provided with a contact portion 172*c* movably associated to the first portion 172. The contact portion 172*c* is also biased towards the second portion 174 using a biasing element 172*s*, for example a spring or other elastically deformable element capable of providing the contact portion 172*c* with a biasing force. The second portion 174 is further provided with one or more spacers 174*d* configured to maintain the contact portion 172*c* at a predefined distance X from the second portion 174 upon contact between the contact portion 172*c* with the one or more spacers 174*d*. The number and arrangement of the spacers 174*d* is also similar to what is described above with respect to FIGS. 1A and 1B. Typically, at least two spacers 174*d* are arranged in the proximity of either end of the first and second portions 172 and 174 in order to provide the gap 176 with a uniform size (e.g. height) along a length thereof.

FIG. 1C illustrates two possible options of actuating the spacers 174*d* if they are not fixedly attached (see, e.g., FIG. 1B) to the second portion 174. On the left of FIG. 1C it is shown that a flow of fluid A is provided and configured to act upon the spacer 174*d*. The spacer 174*d* as shown is movably associated to the second portion 174 so that, in the absence of fluid flow A (e.g. pressurized air), it can remain in or move into a retracted position (not shown), in which the abutment surface 0 of the spacer 174*d* does not protrude from the second portion, thereby not preventing the contact portion 172*c* from contacting the second portion 174. Further, the spacer 174*d* can, when being subjected to fluid flow A (e.g. pressurized air), remain in or move into an extended position (as shown), in which the abutment surface 174*a* of the spacer 174*d* protrudes from the second portion, preventing the contact portion 172*c* from contacting the second portion 174 and keeping the contact portion 172*c* at a predefined distance X from the second portion 174, and thereby providing the gap 176 with a predefined size (e.g. height X).

On the right of FIG. 1C the spacer 174*d* is provided with an actuator M (e.g. an electric actuator or motor). The actuator M is connected to the control unit 60 (not shown in FIG. 1C) and can be controlled, by the control unit 60, to move and maintain the spacer 174*d* at least into/in a first (e.g. retracted) position and into/in a second (e.g. extended) position. The spacer 174*d* as shown is movably associated to the second portion 174 so that the actuator M can be controlled to move it into and maintain it in the retracted position (not shown in FIG. 1C), in which the abutment surface 174*a* of the spacer 174*d* does not protrude from the second portion, thereby not preventing the contact portion 172*c* from contacting the second portion 174. Further, the actuator M can be controlled to move the spacer 174*d* into and maintain it in the extended position (as shown), in which the abutment surface 174*a* of the spacer 174*d* protrudes from the second portion, preventing the contact portion 172*c* from contacting the second portion 174 and keeping the contact portion 172*c* at a predefined distance X from the second portion 174, and thereby providing the gap 176 with a predefined size (e.g. height X).

It is noted that actuated spacers 174*d*, such as shown in FIG. 1C, may be controlled to dynamically adjust the distance X between the contact portion 172*c* and the second portion 174 in order to provide the gap 176 with different sizes (e.g. heights) during the vacuumization process. This can be achieved, for example, by subjecting the spacers 174*d* shown on the left of FIG. 1C with fluid flow A having different pressure over time. The different pressure levels can be employed to cause the spacer 174*d* to be moved from a retracted position to several different extended positions, in which the spacer 174*d* and/or the abutment surface 174*a* of the spacer protrudes from the second portion 174 by a different amount in each of the several different extended positions. This can also be achieved, for example, by controlling the actuators M shown on the right of FIG. 1C to extend/retract the spacers 174*d* by different amounts and to, thus, move the spacers 174*d* from a retracted position to several different extended positions. It is noted that the control unit 60 can be configured to control both the fluid flow A and the actuator(s) M in a corresponding manner.

An advantage of dynamically adjusting the distance X between the contact portion 172*c* and the second portion 174 in order to provide the gap 176 with different sizes (e.g. heights) during the vacuumization process may entail that the size of the gap 176 can be optimized for different phases during vacuumization. For example, a larger gap 176 can promote quick evacuation of the first chamber 180 and/or the package 50 during the beginning of vacuumization, while a smaller gap 176 can facilitate an evacuation of the first chamber 180 and/or the package 50 to a lower pressure during the final stages of vacuumization. Adverse effects, such as steaming, may be reduced or eliminated in this manner, too.

Figure 1D:
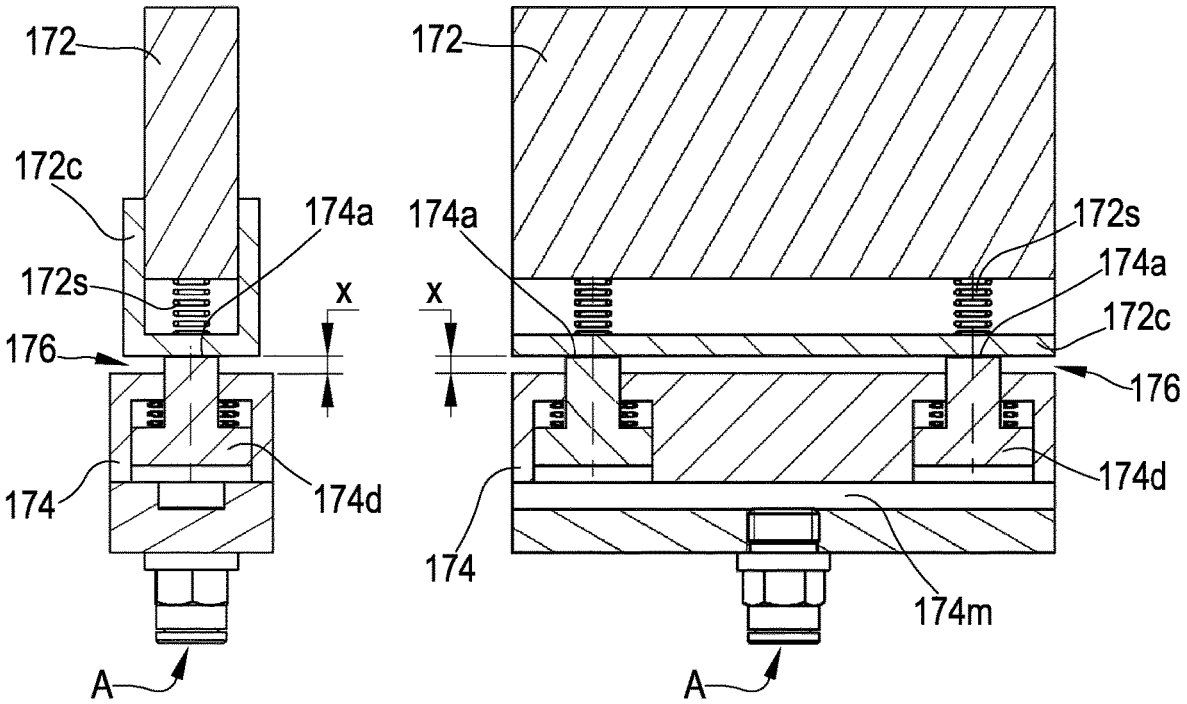
FIG. 1D shows a fourth embodiment of an adjustable gap mechanism in accordance with embodiments of the present invention.

FIG. 1D shows a fourth embodiment of an adjustable gap mechanism in accordance with embodiments of the present invention. This fourth embodiment is largely identical to the one shown on the left of FIG. 1C and corresponding elements have corresponding reference numerals. FIG. 1D illustrates that a plurality of spacers 174*d* may be actuated using a single fluid flow A, which is directed through a common manifold 174*m* and towards the spacers 174*d*. A common actuation of two or more spacers 174*d* can ensure a substantially synchronous actuation of the spacers 174*d*.

It is noted that the control unit 60 may be configured to control the spacers 174*d* in a substantially synchronous manner to ensure a substantially synchronous actuation of the spacers 174*d* and a uniform modification of the size of gap 176 (e.g. uniform along a length thereof). In some embodiments, the spacers 174*d* may be controlled to perform a sequence of actuations, for example first providing the gap 176 with a first size, then decreasing the size of the gap 176 to a second size, and then increasing the size of the gap 176 again to a third size. This can entail the advantage that in a first phase the evacuation is performed quickly until a first pressure is reached, then the pressure differential is increased in a second phase, due to the gap 176 decreasing in size, and in a third phase, the evacuation is sped up again, due to the gap 176 increasing in size again, thereby shortening the time required for the third phase.

In other embodiments, the spacers 174*d* may be controlled to perform a sequence of actuations providing the gap 176 with a first size and then with a second size, the first size being either larger or smaller than the second size. In examples, in which the first size is larger than the second size, this can entail the advantage that evacuation is performed quickly in a first phase, due to the gap 176 having a larger size, and steaming is limited in a second phase, due to the gap 176 having a smaller size at lower pressures and/or near a desired final pressure.

FIG. 2 shows a schematic cross section view of the first embodiment shown in FIG. 1, the package being shown in a state during evacuation. When the evacuation is nearly or fully completed, the package 50 may exhibit the state shown in FIG. 2, where, as an example, the packaging film 52 is shown as closely adhering to the product 20. During evacuation the vacuum pressure applied to the second chamber 180 causes gas/air from the first chamber 160 to be drawn through the gap 176 into the second chamber 180. At the same time, the vacuum pressure applied to the second chamber 180 causes gas/air from inside the package 50 to be drawn through the bag neck into the second chamber 180 (see arrows 178).

Figure 3A:
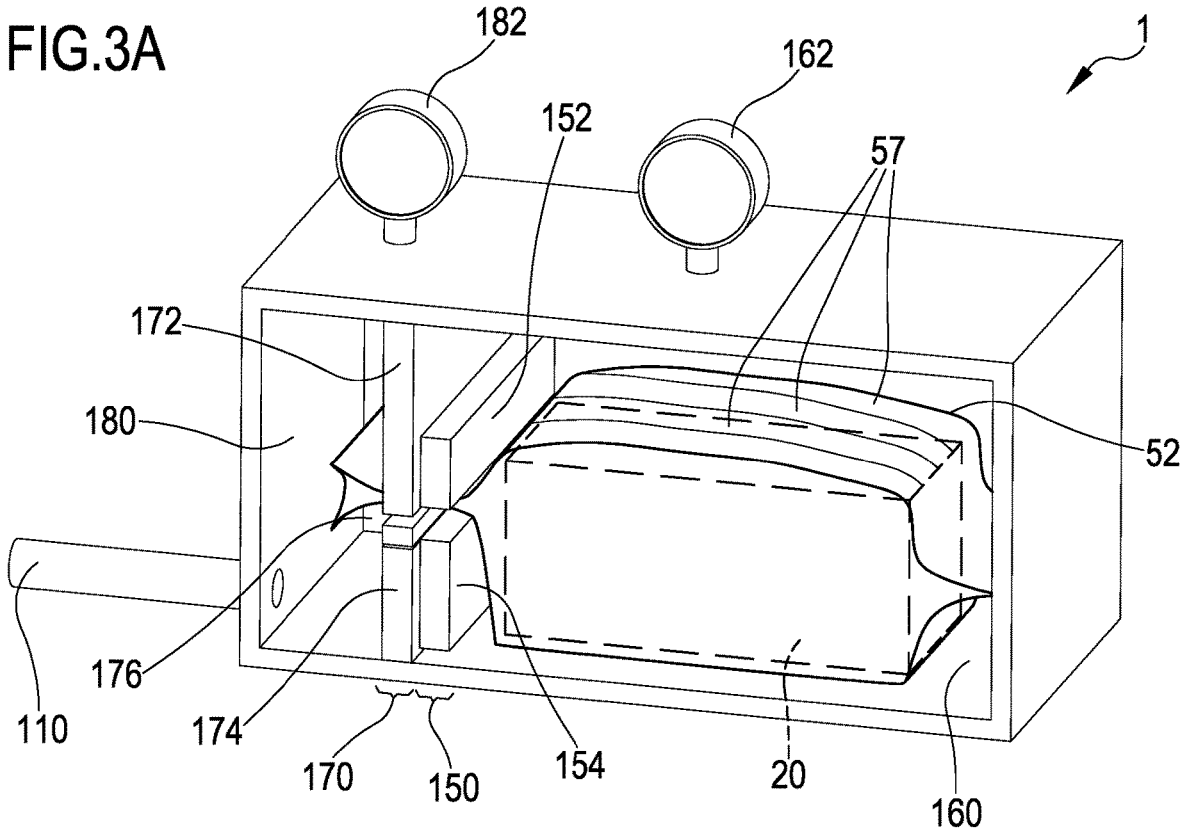
FIG. 3A shows an isometric cross section view of the first embodiment shown in FIGS. 1 and 2, the package being shown in a state prior to evacuation.
Figure 3B:
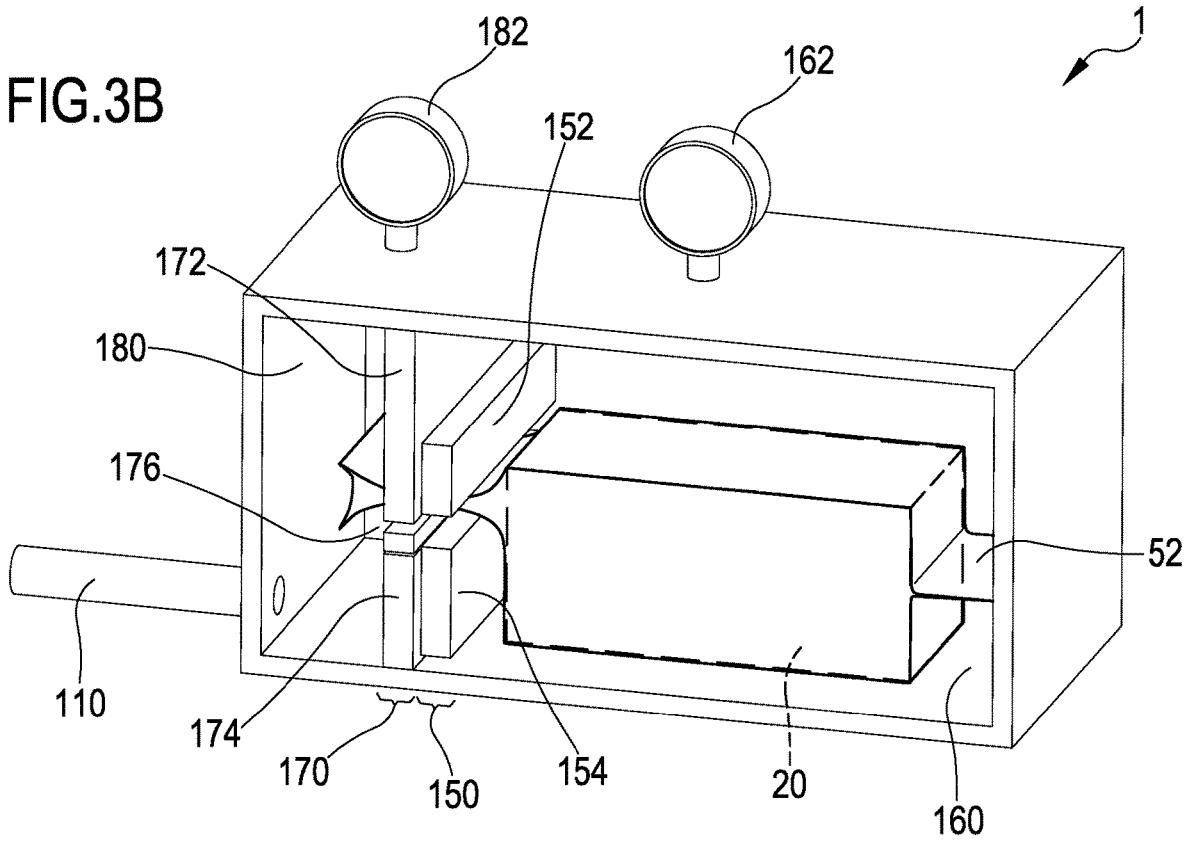
FIG. 3B shows an isometric cross section view of the first embodiment shown in FIGS. 1 and 2, the package being shown in a state during evacuation.

FIG. 3A shows an isometric cross section view of the first embodiment shown in FIGS. 1 and 2, the package being shown in a state prior to evacuation. FIG. 3B shows an isometric cross section view of the first embodiment shown in FIGS. 1 and 2, the package being shown in a state during evacuation. FIGS. 3A and 3B illustrate the non-evacuated and evacuated states of a package 50 in line with what is shown in the cross-section views shown in FIGS. 1 and 2.

As described above, the absolute pressure in the second chamber 180 is lower than the absolute pressure in the first chamber 160. Further, the absolute pressure in the package 50 is also lower than the absolute pressure in the first chamber 160 because the bag neck extending into the second chamber 180 provides for a fluid flow from the inside of the package 50 into the second chamber 180, which is less restricted or offers less resistance in comparison to the fluid flow from the first chamber 160 into the second chamber 180. This is largely due to a large portion of the area of the gap 176 being occupied by the bag neck, thus increasing resistance for fluid flow from the first chamber 160 to the second chamber 180 in the remaining unoccupied portions around the bag neck.

Additionally, the fluid flow from the first chamber 160 and from the inner volume 58 of the package 50 to the second chamber 180 is also based on the volumes involved. The total volume of the first chamber 160 is typically substantially larger than the volume 58 of gas/air inside the package 50. Therefore, if the fluid flow from volume 58 is similar or even lower than the fluid flow from the first chamber 160, the evacuation rate of and/or pressure reduction within the volume 58 is typically still higher than that achieved with respect to the first chamber 160, due to the size of the volume 58 being substantially smaller than the volume of the first chamber 160.

In this manner, gas/air is drawn from the inside of the package 50 into the second chamber 180 by means of the lower pressure present in the second chamber 180. Further, gas/air is also pushed out from the package 50 due to the pressure in the first chamber 160 being higher than the pressure inside the package 50, thereby applying compressive forces on an external surface of the package 50 (see arrows 168 in FIG. 2). It is noted that the evacuation station 1 is controlled so that the pressure inside the package 50 is lower than the pressure in the first chamber 160 and higher than the pressure in the second chamber 180. In order to achieve an effective and efficient evacuation of the package 50, the pressure differential between the first and second chamber 160 and 180 must be carefully controlled.

Upon completion of the evacuation of the package 50 sealing means 150 (e.g. sealing bars 152 and 154) can be controlled to seal the package 50, for example by heat-sealing the packaging film 52. In this manner, the vacuum inside the package 50 is preserved upon opening of the first chamber 160 and/or of the evacuation station 1 when removing the package 50 from the evacuation station. In some embodiments, excess film material, for example extending away from the newly created seal (see, e.g., portions 55 and 54), is cut from the packaging film 52. The cutting may be performed in a separate step during or after sealing or at substantially the same time as the sealing, for example when cutting means are integrated into the sealing means 150.

FIG. 3A shows an isometric cross section view of the first embodiment shown in FIGS. 1 and 2, the package being shown in a state prior to evacuation. In order to achieve efficient and effective evacuation, it may be desired to provide the packaging film with creases or wrinkles 57, preferably extending along the length of the package 50 (e.g. towards the gap 176). This can be achieved by providing the gap 176 with a corresponding shape (see FIG. 1B) or by providing the packaging film 52 with a suitable structure (e.g. pre-formed predetermined folding lines).

Figure 4:
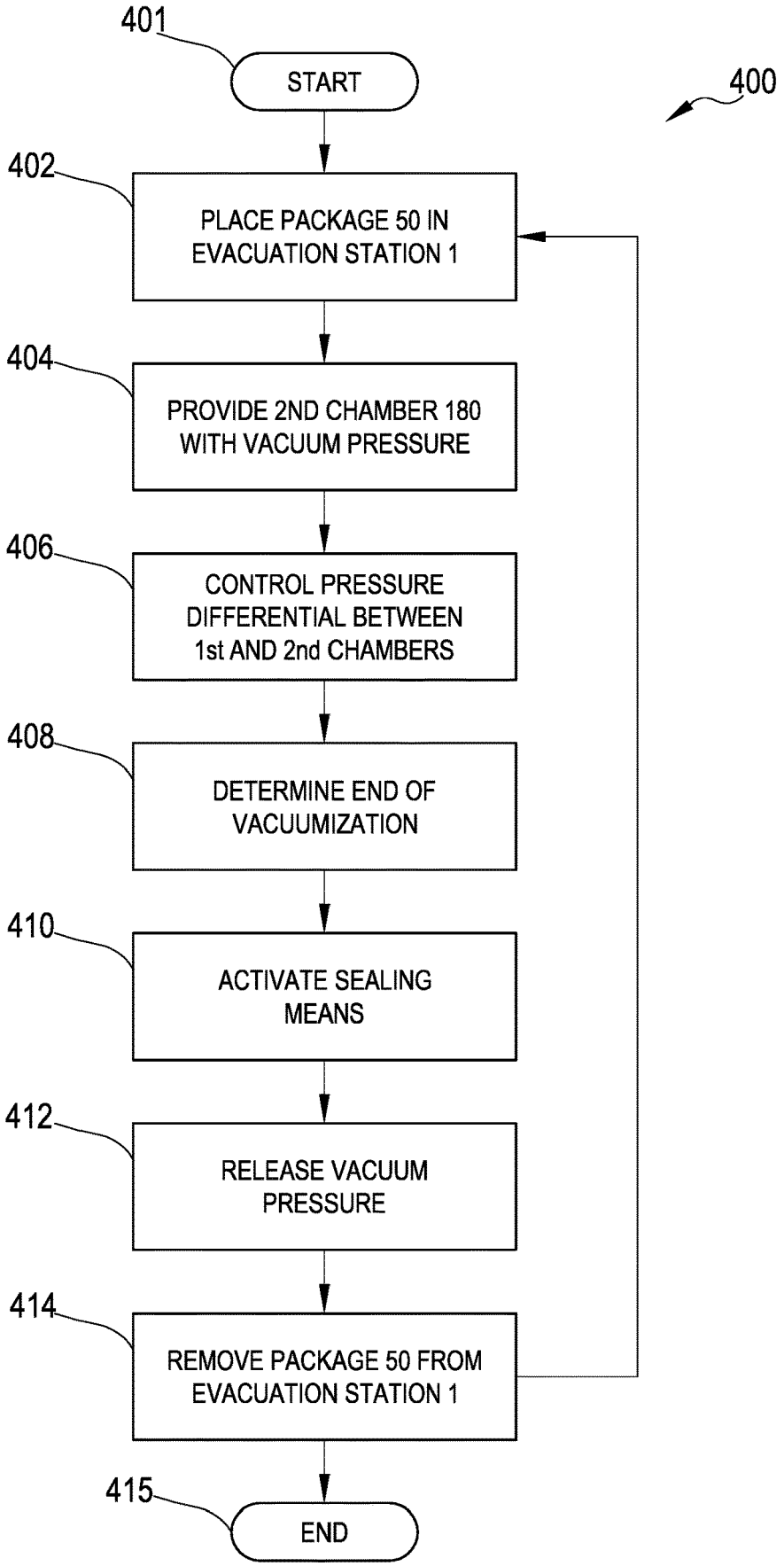
FIG. 4 shows a flow chart illustrating an example evacuation process in accordance with the present invention.

FIG. 4 shows a flow chart illustrating an example evacuation process in accordance with the present invention. The process 400 starts at step 401. In step 402, a package 50 is placed in the first chamber 160 of the evacuation station 1. In step 404, the first chamber 160 and/or the evacuation station 1 is closed, sealingly housing the package 50 as shown in FIG. 1, with the bag neck extending from the first chamber 160 through the gap 176 and into the second chamber 180.

In step 406, a vacuum is applied to the second chamber 180. This can be achieved by controlling a vacuum pump 116 and/or a control valve 112. In some embodiments, regulating the power supplied to the vacuum pump (e.g. the power supplied to a motor driving the pump) controls the performance of the vacuum pump (e.g. the vacuum pressure generated). As known in the art, a variable speed drive (VSD) can be employed here. In this manner, the control unit 60 can control the vacuum pressure generated by the vacuum pump 116. In other embodiments, a vacuum source is connected to the second chamber and the vacuum supplied through line 110 is regulated by controlling the control valve 112, thereby controlling an absolute pressure in the second chamber 180 based on the vacuum pressure supplied by the vacuum source and by a control position of the valve 112. In step 406, the absolute pressure in the second chamber 180 is reduced based on a predetermined pressure profile characterized by a pressure curve indicative of an absolute pressure value over time. In some examples, the absolute pressure within the second chamber 180 is reduced in a declining manner, reducing the pressure first at a higher rate and reducing the rate as the pressure drops, leading to an asymptotic pressure curve for the second chamber 180 (see also detailed description of FIGS. 5A and 5B). The vacuum pressure applied to the second chamber 180 is controlled in order to achieve a desired evacuation of the package 50, for example based on a target absolute pressure in the first chamber 160 and/or a target evacuation time reached.

Figure 4A:
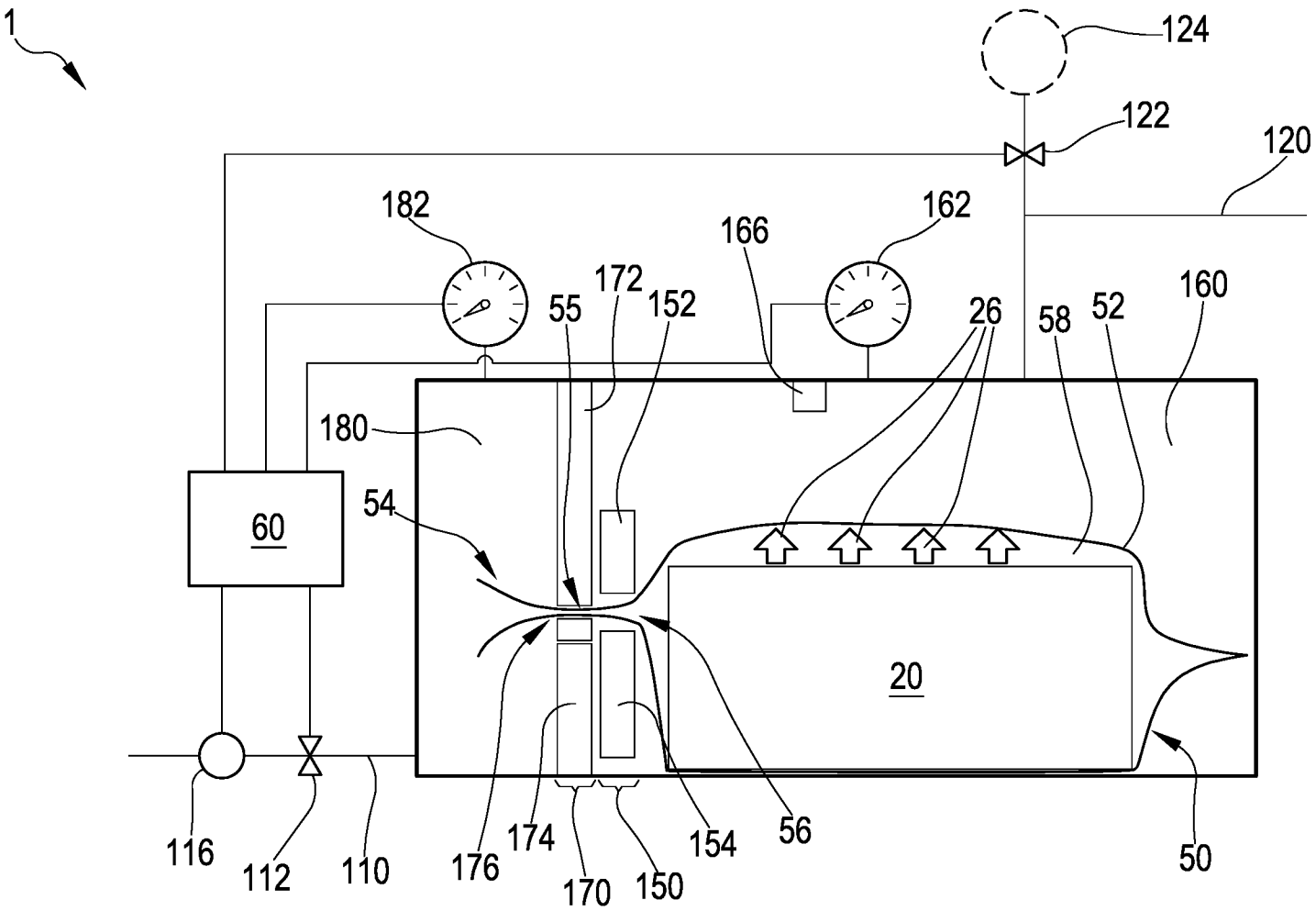
FIG. 4A shows a schematic cross section view of the first embodiment of an evacuation station of a packaging apparatus according to the present invention, the package being shown in a state where evaporation occurs.

FIG. 4A shows a schematic cross section view of the first embodiment of an evacuation station of a packaging apparatus according to the present invention, the package being shown in a state where evaporation or steaming occurs. As mentioned above, the evacuation process may cause the product to evaporate fluid, for example water, which transitions from liquid into gaseous form and is evacuated along with the gas/air contained within the package. This may occur, in particular, when the evacuation process is performed with very low target pressures, for example less than 20 mbar at a temperature of the product 20 of between about 15° C. to about 20° C. Undesired evaporation of liquid, or steaming, can be detected in several ways.

One way to detect steaming is based on monitoring the absolute pressure in the first chamber 160. As shown in FIG. 4A, steaming (e.g. evaporation of water from a meat product 20) typically entails packaging film 52 being pushed outward from the product 20 by the newly created steam (e.g. water vapor) before being drawn from the package 50 through the bag neck and into the second chamber 180. Such a change in the configuration of the packaging film 52 leads to a change in the pressure drop gradient (e.g. a change in the reduction rate) or even to a transient pressure increase (e.g. the reduction rate becoming negative) in the first chamber 160, both of which can be detected by the control unit 60 based on the control signal provided by the pressure sensor 162.

Another way to detect steaming is based on monitoring a shape of the package 50 in the first chamber 160. As described above, steaming typically entails packaging film 52 being pushed outward from the product 20 by the newly created steam (e.g. water vapor) before being drawn from the package 50 through the bag neck and into the second chamber 180. Such a change in the configuration of the packaging film 50 leads to a change in the shape of the packaging film 52. Upon the occurrence of steaming, the packaging film is either not further drawn towards the product 20 or even lifts away from the product 20, both of which can be detected by the control unit 60 based on the control signal provided by a corresponding sensor 166. Sensor 166 may be an optical sensor configured to detect a distance from the sensor to the packaging film 21. Suitable optical sensors include, for example, sensors configured to detect wavelengths within the visible spectrum, laser light, and infrared light.

Upon the detection of steaming, the control unit 60 can prevent substantial (or further) loss of product weight by not further reducing the absolute pressure in the first chamber 160 and/or by sealing the package 50. This is described in further detail below. In some embodiments, the control unit 60 may be configured to slightly increase the absolute pressure in the first chamber 160 by a predetermined amount in order to stop the steaming immediately. The predetermined amount typically ranged between 5 and 100 mbar, preferably between 5 and 50 mbar. To this aim, an air inlet line 120 connected to the second chamber 160 and in fluid communication with ambient pressure, as well as a corresponding inlet valve 122 connected to the control unit 60 can be provided. Upon detection of steaming, the control unit 60 can control the inlet valve 122 to open (at least partially) in order to allow ingress of air into the second chamber 160. The inlet valve can be of a similar or identical type to valve 112 and can be operated in a similar manner (i.e. including partially or fully opening and/or closing). In other embodiments, the inlet line can further be in fluid communication with a source of pressurized air 124 in order to achieve the desired increase in pressure in the second chamber 160 (see above; e.g. 5 to 50 mbar) in a shorter time than with the supply of air at ambient pressure.

Figure 4B:
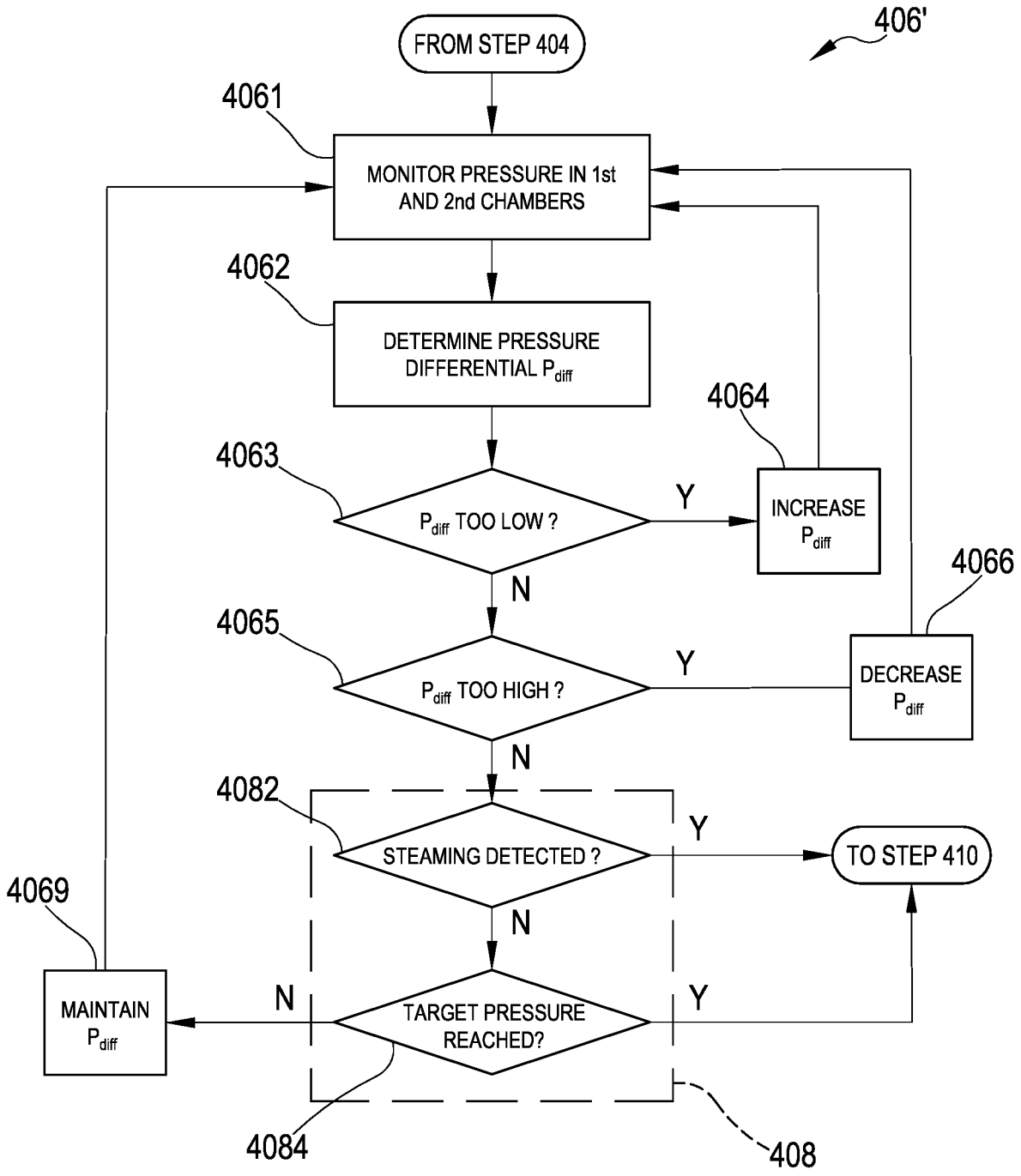
FIG. 4B shows a flow chart illustrating an example control process in accordance with the present invention.

FIG. 4B shows a flow chart illustrating an example control process in accordance with the present invention. The control process 406' is part of steps 406 (and 408) as shown in FIG. 4 and starts at step 4061, in which the control signals of the pressure sensors 162 and 182 are monitored. In step 4062, a pressure differential value $p_{diff}$ is calculated. In step 4063 it is determined whether $p_{diff}$ is below a minimum value. This is typically the case at the beginning of evacuation, where a pressure differential has to be created. Further, in the first stage of evacuation, $p_{diff}$ is typically increased until a desired maximum value is reached. The control unit 60 can control the vacuum pump 116 and/or the control valve 112 in order to increase $p_{diff}$ in step 4064. This is repeated or maintained until a minimum value for $p_{diff}$ is reached.

In step 4065 it is determined whether $p_{diff}$ is higher than a maximum value. This typically occurs in a second stage of evacuation, in which $p_{diff}$ is typically decreased. However, this may also occur under other circumstances. Again, the control unit 60 can control the vacuum pump 116 and/or the control valve 112 in order to decrease $p_{diff}$ in step 4066. This is repeated or maintained until $p_{diff}$ drops below a desired maximum value. It is noted that during evacuation, the desired minimum and maximum values change over time so that the range between the desired minimum and maximum values constantly changes and typically increases over a first stage of evacuation up to 200 mbar ($p_{diff}$) at around 300 mbar of absolute pressure in the second chamber 180 and/or after about 3.0 seconds of evacuation, and typically decreases increases over a second stage of evacuation down to about 20-10 mbar ($p_{diff}$) or less at around 50 mbar of absolute pressure in the second chamber 180 and/or after about 8.0 seconds of evacuation.

Here, control process 406' overlaps with step 408 as shown in FIG. 4, in which the control unit determines, whether the vacuumization is to be concluded. If, for example, the control unit 60 detects steaming (see step 4082), the sealing means 150 are controlled to seal the package 50 before evacuation of a substantial amount of steam or vapor from inside the package. If steaming occurs, the process 406' returns to step 410 in process 400 (see FIG. 4). Optionally, before the package 50 is sealed, the absolute pressure in the first chamber is either maintained or increased as described above in order to stop the steaming.

Otherwise, when the target absolute pressure is reached in the first chamber 160 (see step 4084), then the sealing means 150 are controlled to seal the package 50. Also in this case, the process 406' returns to step 410 in process 400 (see FIG. 4). Otherwise, if the target absolute pressure has not been reached in the first chamber 160 yet, the process 406' continues in step 4069 by maintaining $p_{diff}$ within the desired limits (see above). In this case, the process returns to step 4061 and is continued until either steaming is detected or the target pressure is reached.

It is noted that the control unit can be configured to determine whether the vacuumization is to be concluded based on further conditions, in addition or in alternative to the occurrence of steaming or reaching a target absolute pressure. Such further conditions may be combined with each other, or with the conditions described above. For example, the control unit can be configured to determine that the vacuumization is to be concluded, when a maximum evacuation time (e.g. as measured from the beginning of step 404; see FIG. 4) has elapsed. This can be beneficial, for example, when a desired target absolute pressure consists of a pressure range (e.g. 8-12 mbar), defining a range of target absolute pressures acceptable for a particular application. In such examples, it may be desired to continue with the vacuumization even beyond reaching an absolute pressure of 12 mbar in order to improve vacuumization, but to limit total vacuumization time if the lower limit of 8 mbar cannot be reached within the time prescribed by the maximum evacuation time. Additionally, setting a maximum vacuumization time can serve to prevent prolonged vacuumization, for example in cases of defects or malfunctions (e.g. including faulty products, defective packaging material, issues with the packaging machine).

Figure 5A:
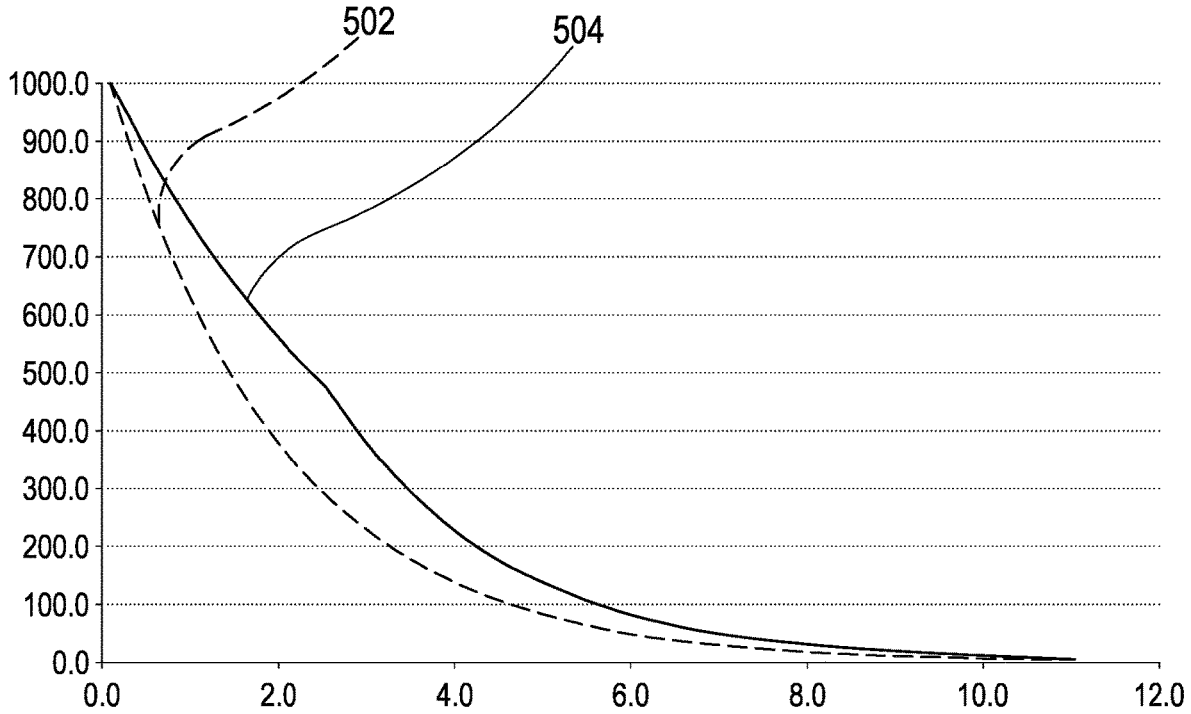
FIG. 5A shows a diagram illustrating an example vacuum control curve based on which evacuation according to embodiments of the present invention can be controlled.
Figure 5B:
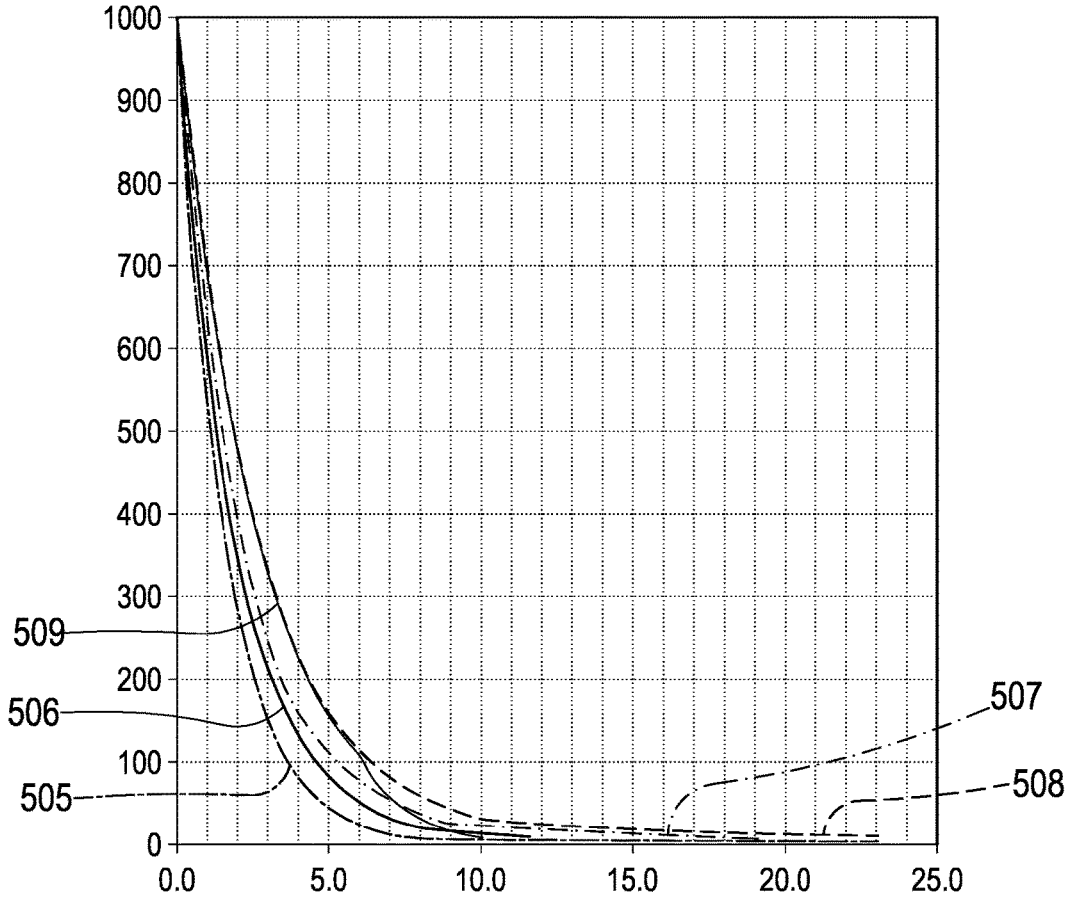
FIG. 5B shows a diagram illustrating further example vacuum control curves based on which evacuation according to embodiments of the present invention can be controlled.

FIG. 5A shows a diagram illustrating an example vacuum control curve based on which evacuation according to embodiments of the present invention can be controlled. FIGS. 5A and 5B both show specific examples based on concrete implementations of the invention. It is noted that these examples are not intended to limit the inventive concepts as, in general, all described embodiments reliably operate based on a range of parameters and depending upon the individual process (e.g. type and properties of packaging material; size, number, and properties of packaged goods; size of vacuum chambers).

Generally, one objective is to minimize the overall process time depending upon the packaged goods. The process, however, will work if longer process times are desired or necessary. Depending on the size of the vacuum chamber, the process may be implemented to facilitate vacuumization of the first chamber 160 to a pressure of about 10 mbar in a time ranging from 5-7 seconds to about 30 seconds. In one embodiment vacuumization to about 10 mbar using a (medium to large sized) chamber having an internal volume of about 0.4 $m^3$ volume can be performed in the within 9 to 30 seconds, preferably 9 to 12 seconds. Chambers of such size (e.g. medium/large chambers) can be employed in vacuumizing multiple products in a single vacuumization step (e.g. by placing multiple packages 50 into the first chamber 160 at the same time). Generally, the second chamber 180 has a size of between about 2% to about 10% of the size of the first chamber 160.

In other embodiments designed for vacuumization of single products, the vacuum chamber (i.e. the first chamber 160) may be provided with a smaller size. Chambers for such application may typically be provided with a size in the range of 0.03 to 0.08 $m^3$. In embodiments employing such smaller vacuum chambers the time required for vacuumization can be shortened and may be in the range of 4 to 12 seconds, preferably 5 to 8 seconds.

In order to achieve both a reasonable evacuation time, which typically means that the evacuation time should be as short as possible, but also to provide the package 10 with a desired vacuum while reducing or eliminating steaming, the absolute pressure in the second and first chambers 180 and 160, as well as the pressure differential $p_{diff}$, have to be carefully controlled. To this aim, the absolute pressure 502 in the second chamber is typically reduced from about ambient pressure to about 400 mbar within the first 2.0 seconds of evacuation and further down to about 250 mbar during the time between 2.0 to 3.0 seconds of evacuation (see absolute pressure graph 502 in FIG. 5A). At the same time, $p_{diff}$ increases to a value of up to 200 mbar at around 300 mbar of absolute pressure in the second chamber 180 and/or after about 3.0 seconds of evacuation. Thereafter, the absolute pressure in the second chamber is further reduced to a target pressure of about 5 mbar within the following 5.0 to 7.0 seconds of evacuation (i.e. about 8.0 to about 10.0 seconds after beginning of evacuation). At the same time, $p_{diff}$ decreases down to a value of about 10 mbar ($p_{diff}$) or less.

As can be seen from the example in FIG. 5A, the absolute pressure 504 in the first chamber 160 is reduced differently in a first phase (up to approximately 2.3 seconds and down to a pressure of approximately 480 mbar) and in a second phase (after approximately 2.3 seconds and below approximately 480 mbar). This can be achieved using an adjustable gap 176, which facilitates control of the vacuumization in this manner. In the first phase, it is desired to control the vacuumization such that the absolute pressure in the first chamber 160 does not decrease too quickly (e.g. to limit the amount of gas/air flowing from the inner volume 58 of the package 50 and from the first chamber 160 towards and into the second chamber 180), thereby ensuring that gas/air can be thoroughly aspirated from the inner volume 58 the package 50 while reducing the danger of steaming. This can be achieved by providing the adjustable gap 176 with a first size (e.g. height) during the first phase, which is relatively smaller than a second size of the adjustable gap 176 during the second phase. In the second phase, it is desired to control the vacuumization such that the absolute pressure in the first chamber 160 is further reduced at an increased rate (e.g. to increase the amount of gas/air flowing from the inner volume 58 of the package 50 and from the first chamber 160 towards and into the second chamber 180), thereby reducing the time required to reach the desired target pressure in the package 50 and/or the first chamber 160. This can be achieved by providing the adjustable gap 176 with a second size (e.g. height) during the second phase, which is relatively larger than the first size of the adjustable gap 176 during the first phase. In some examples, the size of the adjustable gap 176 ranges from about 0.3 mm to about 0.5 mm, preferably 0.35 mm to 0.45 mm, in the first phase, and from about 1.0 mm to about 2.0 mm, preferably 1.25 mm to 1.75 mm, more preferably 1.4 mm to 1.6 mm, in the second phase.

FIG. 5B shows a diagram illustrating further example vacuum control curves based on which evacuation according to embodiments of the present invention can be controlled. Pressure curve 505 illustrates a standard hard vacuum process with a target pressure of 5 to 10 mbar. A standard hard vacuum process typically facilitates quick vacuumization but may entail substantial disadvantages, for example steaming.

Pressure curves 506, 507, and 508 illustrate the progression of the absolute pressure within the first chamber 160 when gaps 176 having different sizes are applied. Pressure curve 506 is based on a gap size of 1.1 mm, pressure curve 507 is based on a gap size of 0.6 mm, and pressure curve 508 is based on a gap size of 0.4 mm. The different progressions of the absolute pressure within the first chamber 160 illustrate the vacuumization process achieved. While a quick vacuumization may quickly establish a desired target pressure within the first chamber 160, this may also entail substantial disadvantages, for example steaming.

In order to avoid steaming or other adverse effects, it is desired to control the vacuumization process as illustrated by pressure curve 509. Similar to what is shown in FIG. 5A and pressure curve 504, pressure curve 509 can be achieved by performing vacuumization of the first chamber using an adjustable gap 176. In the example shown, the gap 176 is provided during a first phase of vacuumization (down to approximately 100 mbar absolute pressure) with a size of 0.4 mm and in a second phase of vacuumization (below approximately 100 mbar absolute pressure) with a size of 1.5 mm. This allows a controlled vacuumization of the first chamber 160, which, in the first phase, facilitates a sufficiently thorough evacuation of the inner volume 58 of the package 50 while not taking an excessively long time, and, in the second phase, facilitates a relatively quick evacuation of the first chamber 160 and the package 50 in order to prevent steaming to occur before the desired target pressure of about 10 mbar is reached.

The packaging can comprise a multi-layer film 52. The film 52 can comprise a polyolefin. The film 52 can be a fully coextruded shrinkable film 52. The package provides a barrier to gas passing between the interior of the package to the exterior of the package. Accordingly, the environment inside the package is isolated from the environment outside the package. This helps to preserve food products 50 and to avoid contamination. This can be advantageous with respect to food hygiene. The package 50 can provide a barrier to aromas or to gasses. This can be particularly useful when the product 20 is a food product. The package can be abuse-resistant.

The packaging can be transparent or translucent. This allows a customer to see the product 20 through the packaging. For example, the packaging may comprise a transparent film 52. The packaging film can have anti-fog properties. This ensures high consumer appeal. The packaging film can be printable. This allows labels to be printed directly onto the packaging.

The packaging may be formed from a roll of film 52. The tubular film 52 can be made by forming a tube from the roll of film 52. The packaging apparatus can comprise a forming station configured to form the roll of film 52 into a tube. The forming station can form the tube by forming a longitudinal seal along the longitudinal edges of the roll of film 52. The tube may be formed from two webs of film 52. In this case, the forming station forms two longitudinal seals along the opposing edges of the two rolls of film 52.

The packaging apparatus can comprise a flusher. The flusher is configured to flush gas through the tube of film 52 that forms the packaging. The gas flush may prevent the tube from collapsing. The gas flush helps to maintain a distance between a product 20 in a tray and the film 52. This helps to improve the hygienic appearance of the film 52 because the film 52 remains untarnished by the product. The flusher flushes gas longitudinally through the tube. The gas used for flushing can comprise about 70% oxygen and about 30% carbon dioxide or other suitably modified atmosphere.

Additionally, the flush gas allows the product 20 to be packaged in a modified atmosphere. The gas may help to preserve the product 20, prolonging its shelf life. The desired amount of gas inside each sealed package depends on the type of product 20 and the length of shelf life needed.

The packaging apparatus can comprise a shrink station configured to shrink the film 52. The shrink station may be a water- or air-based shrink tunnel, for example a hot air tunnel. After sealing, packages 50 undergo heat-shrinking in the shrink station. The shrinking process may involve heating the packages 50. The packages 50 may be heated to a temperature at which shrinking of the packaging film is enabled, for example within the range of from about 60° C. to about 150° C. However, heat shrinking a package depends on a number of factors (e.g. film properties, properties of the packaged goods, shrinking equipment employed) so that individual parameters may be adapted to the specific case. The product 20 can be a food product. For example, the product 20 may comprise meat, cheese, pizza, ready meals, poultry and fish.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and the scope of the appended claims.

The invention claimed is:

1. A packaging process comprising:

providing an evacuation station having a first chamber, a second chamber, and a dividing wall, the dividing wall separating the first chamber from the second chamber and having a gap fluidly coupling the first chamber and the second chamber, the gap having a size, the second chamber being fluidly coupled to a vacuum source configured to apply a controlled vacuum pressure to the second chamber, the evacuation station being provided with a control unit configured to control the vacuum source; providing a package containing a product to be packaged, the package being made from a film and having an open end;

arranging the package in the evacuation station such that:

a terminal portion of the open end is positioned within the second chamber, a non-terminal portion of the open end and the product are positioned within the first chamber, and an intermediate portion of the open end passes through the gap, the intermediate portion extending between the terminal portion and the non-terminal portion of the open end, the open end putting an inner volume of the package in fluid communication with an inner volume of the second chamber;

controlling, by the control unit, a pressure differential between a first internal pressure in the first chamber and a second internal pressure in the second chamber to cause aspiration of gas from the inner volume of the package, wherein the step of controlling the pressure differential comprises at least one of:

increasing the pressure differential, the step of increasing the pressure differential including decreasing the size of the gap, or decreasing the pressure differential, the step of decreasing the pressure differential including increasing the size of the gap.

2. The process of claim 1, wherein the step of controlling the pressure differential further comprises at least one of:

the step of increasing the pressure differential including controlling the vacuum source to decrease an absolute pressure value of the controlled vacuum pressure applied to the second chamber; or the step of decreasing the pressure differential including controlling the vacuum source to maintain or increase an absolute pressure value of the controlled vacuum pressure applied to the second chamber.

3. The process of claim 1, wherein controlling the pressure differential comprises one or more of:

increasing the pressure differential during a first evacuation phase; and decreasing the pressure differential during a second evacuation phase.

4. The process of claim 1, wherein controlling the pressure differential comprises:

providing the gap with a first size during an initial evacuation phase;

providing the gap with a second size during a transitional evacuation phase; and providing the gap with a third size during a final evacuation phase; wherein the initial evacuation phase, the transitional evacuation phase, and the final evacuation phase are performed in sequence, the second size being smaller than the first and third sizes.

5. The process of claim 1, wherein the evacuation station comprises:

a first pressure sensor configured to generate a first pressure signal indicative of the first internal pressure present in the first chamber; and a second pressure sensor configured to generate a second pressure signal indicative of the second internal pressure present in the second chamber; and wherein the control unit is further configured to:

receive the first pressure signal and the second pressure signal; and determine the pressure differential based on the first pressure signal and the second pressure signal.

6. The process of claim 1, wherein the gap is provided with an elongated shape; and the control unit is configured to control the pressure differential to not exceed an absolute value of about 300 mbar.

7. The process of claim 1, wherein arranging the package in the evacuation station further comprises:

opening the first chamber (160);

introducing the open end of the package (50) into the gap (176) along a length of the gap (176) and positioning the package (50) within the first chamber (160), such that:

the terminal portion of the open end is positioned within the second chamber, the non-terminal portion of the open end and the product are positioned within the first chamber, and the intermediate portion of the open end passes through the gap; and closing the first chamber.

8. The process of claim 1, further comprising:

determining a vacuumization condition of the package; and sealing the package.

9. The process of claim 8, wherein the control unit is further configured to determine the vacuumization condition when the first internal pressure is at or below a predetermined target value; and the control unit is further configured to:

determine a steaming condition of the package; and determine the vacuumization condition when the steaming condition of the package is determined.

10. The process of claim 9, wherein the control unit is further coupled to a third sensor configured to emit a control distance signal indicative of a control distance between the third sensor and a portion of the film and wherein the control unit is further configured to determine the steaming condition when, during the step of controlling the pressure differential the control distance decreases by an amount of 2% or more with respect to a current maximum control distance, the current maximum control distance being determined based on the control distance signal.

11. The process of claim 9, wherein the control unit is coupled to an inlet valve, the inlet valve being arranged on an inlet line configured to put the first chamber into fluid communication with an ambient atmosphere or with a source of pressurized air, and wherein the control unit is configured to provide the first chamber with an increase in the first internal pressure by controlling the inlet valve.

12. The process of claim 1, wherein the control unit is further coupled to one or more actuators configured to provide the gap with at least a first size and a second size in response to corresponding control signals provided by the control unit, the first size and the second size being different from one another.

13. The process of claim 1, wherein arranging the package in the evacuation station further comprises:

opening the first chamber, the second chamber, and the gap;

positioning the terminal portion of the open end within the second chamber;

positioning the non-terminal portion of the open end and the package within the first chamber;

positioning the intermediate portion of the open end in superposition with the opened gap; and closing the gap, the first chamber, and the second chamber.

14. A device for evacuating gas from a package in a packaging apparatus, the device comprising:

a first chamber;

a second chamber; and a dividing wall separating the first chamber from the second chamber and having a gap fluidly coupling the first and second chambers, the gap having a size;

wherein the device is configured to receive a package containing a product to be packaged, the package being made from a film and having an open end, the open end having a terminal portion, a non-terminal portion, and an intermediate portion located between the terminal portion and the non-terminal portion of the open end, the device being configured to receive the package such that:

a terminal portion of the open end is positioned within the second chamber, a non-terminal portion of the open end and the product are positioned within the first chamber, and an intermediate portion of the open end passes through the gap, the intermediate portion extending between the terminal portion and the non-terminal portion of the open end, the open end putting an inner volume of the package in fluid communication with an inner volume of the second chamber;

wherein the device further comprises:

a vacuum source fluidly coupled to the second chamber and configured to apply a controlled vacuum pressure to the second chamber; and a control unit configured to control the vacuum source, wherein the control unit is configured to control a pressure differential between a first internal pressure in the first chamber and a second internal pressure in the second chamber, the pressure differential being controlled to cause aspiration of gas from the inner volume of the package, wherein the control unit is configured to control a pressure differential by at least one of:

increasing the pressure differential, the step of increasing the pressure differential including decreasing the size of the gap, or decreasing the pressure differential, the step of decreasing the pressure differential including increasing the size of the gap.

15. The device of claim 14, wherein:

the first chamber is provided with a first pressure sensor configured to generate a signal indicative of a first internal pressure in the first chamber, and the second chamber is provided with a second pressure sensor configured to generate a signal indicative of a second internal pressure in the second chamber; and wherein the control unit is further configured to:

receive the respective signals from the first and second pressure sensors indicative of the respective first and second internal pressures in the first and second chambers; and control the pressure differential based on the first and second internal pressures in the first and second chambers.

16. The device of claim 14, wherein the control unit is further coupled to a third sensor configured to emit a control distance signal indicative of a control distance between the third sensor and a portion of the film and wherein the control unit is further configured to determine the steaming condition when, during the step of controlling the pressure differential the control distance decreases by an amount of 2% or more with respect to a current maximum control distance, the current maximum control distance being determined based on the control distance signal.

17. The device of claim 15, wherein the control unit is coupled to an inlet valve, the inlet valve being arranged on an inlet line configured to put the first chamber into fluid communication with an ambient atmosphere or with a source of pressurized air, and wherein the control unit is configured to provide the first chamber with an increase in the first internal pressure by controlling the inlet valve.

18. The device of claim 14, wherein the control unit is further coupled to one or more actuators configured to provide the gap with at least a first size and a second size in response to corresponding control signals provided by the control unit, the first size and the second size being different from one another.

19. The device of claim 18, wherein the dividing wall includes the first portion and a second portion.

20. The device of claim 19, wherein the first portion includes an upper portion based on a use configuration of the evacuation station and wherein the second portion includes a lower portion based on a use configuration of the evacuation station.

21. A packaging apparatus comprising:

an evacuation station comprising the device of claim 14, wherein the evacuation station is coupled to the control unit of the device; and an output station.

* * * * *